US008770781B2

(12) United States Patent
Yamamoto et al.

(10) Patent No.: US 8,770,781 B2
(45) Date of Patent: Jul. 8, 2014

(54) LIGHTING APPARATUS

(75) Inventors: Hiroyuki Yamamoto, Osaka (JP); Osamu Bando, Osaka (JP); Noritaka Okamura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 234 days.

(21) Appl. No.: 13/377,192

(22) PCT Filed: Jun. 3, 2010

(86) PCT No.: PCT/JP2010/059422

§ 371 (c)(1),
(2), (4) Date: Dec. 9, 2011

(87) PCT Pub. No.: WO2010/143577

PCT Pub. Date: Dec. 16, 2010

(65) Prior Publication Data

US 2012/0081912 A1 Apr. 5, 2012

(30) Foreign Application Priority Data

Jun. 10, 2009 (JP) ..... 2009-139557
Jun. 10, 2009 (JP) ..... 2009-139558

(51) Int. Cl.
*F21V 29/00* (2006.01)
*F21V 23/00* (2006.01)
*F21V 21/00* (2006.01)

(52) U.S. Cl.
USPC ..... 362/148; 362/365; 362/373

(58) Field of Classification Search
USPC ..... 362/147, 148, 149, 150, 218, 294, 364, 362/365, 366, 368, 373
See application file for complete search history.

(56) References Cited

U.S. PATENT DOCUMENTS

| | | | | |
|---|---|---|---|---|
| 7,651,248 | B2 * | 1/2010 | Hua | 362/373 |
| 8,042,973 | B2 | 10/2011 | Inoue et al. | |
| 2009/0086474 | A1 * | 4/2009 | Chou | 362/230 |
| 2009/0097262 | A1 | 4/2009 | Zhang et al. | |

FOREIGN PATENT DOCUMENTS

| | | |
|---|---|---|
| EP | 2 034 234 A1 | 3/2009 |
| EP | 2 163 809 A2 | 3/2010 |
| EP | 2 180 241 A2 | 4/2010 |
| EP | 2 189 710 A2 | 5/2010 |
| JP | 3-179607 | 8/1991 |

(Continued)

OTHER PUBLICATIONS

International Search Report, dated Jul. 13, 2010, issued in PCT/JP2010/059422.

*Primary Examiner* — Laura Tso
(74) *Attorney, Agent, or Firm* — Birch, Stewart, Kolasch & Birch, LLP

(57) ABSTRACT

It is expected to provide a lighting apparatus that can improve the radiation performance. In a lighting apparatus that includes a light source unit and a heat sink radiating the heat generated by the light source unit and is recessed and installed to an attaching hole opened on a mounted portion, the heat sink is exposed at least partially to a side where the light from the light source unit is emitted from the attaching hole. For example, when installed to a ceiling having a heat insulated structure, the heat generated by the light source unit and transferred to the heat sink is transferred inside the heat sink and radiated from one part to the air at the side where the light from the light source unit is emitted from the attaching hole. Therefore, the radiation performance can be improved.

15 Claims, 17 Drawing Sheets

(56) References Cited

FOREIGN PATENT DOCUMENTS

| | | | |
|---|---|---|---|
| JP | H8-298390 | A | 11/1996 |
| JP | 2003-100110 | A | 4/2003 |
| JP | 2004-179048 | A | 6/2004 |
| JP | 2006-260986 | A | 9/2006 |
| JP | 2008-4363 | A | 1/2008 |
| JP | 2008-204698 | A | 9/2008 |
| JP | 2008-282829 | A | 11/2008 |
| JP | 4174554 | B1 | 11/2008 |
| JP | 2009-64636 | A | 3/2009 |
| JP | 2009-64637 | A | 3/2009 |

* cited by examiner

LIGHTING APPARATUS

This application is the National Phase of PCT/JP2010/059422 filed on Jun. 3, 2010, which claims priority under U.S.C. 119(a) to Patent Application Nos. 2009-139557 and 2009-139558 filed in Japan on Jun. 10, 2009, all of which are hereby expressly incorporated by reference into the present application.

BACKGROUND OF THE INVENTION

1. Field of the Invention

The present invention is related to a lighting apparatus attached to a mounted portion, such as a ceiling.

2. Description of Related Art

A lighting apparatus is known that is attached to an attaching hole opened at a mounted portion, such as a ceiling. For example, there is a recessed lighting apparatus, such as a so-called downlight, in which a main body of the lighting apparatus is configured to have a closed-end cylindrical shape, and a part or whole of the main body is inserted into the attaching hole to be fixed at the mounted portion. This recessed lighting apparatus may be mounted to the mounted portion by a mounting member, such as a leaf spring, provided at a proper position on the periphery of the main body, and a light source provided at a side of the main body is arranged at a side closer to the attaching hole (for example, see Patent Document 1).

A lighting apparatus disclosed by the Patent Document 1 includes a main body, a light source, a power supply device that controls an electrical current supplied to the light source, a terminal block utilized for relaying power externally supplied to the power supply device, and a pair of attaching springs. The main body is configured with an annular side wall, a radiator fin arranged on the annular side wall, and a bottom wall that separates the annular side wall into upper and lower spaces. The light source is arranged under the bottom wall, and the power supply device is arranged in an accommodating area defined by the bottom wall and the upper portion of the annular side wall. The terminal block relaying the power externally supplied to the power supply device is attached to the outer surface of the upper portion of the annular side wall. The lighting apparatus further includes: a baffle that is made of synthetic resin, formed in a cylindrical shape with an annular flange and is arranged under the lower portion of the annular side wall; and a pair of attaching springs arranged on the outer surface of the baffle. The terminal block is attached to the outer surface of the annular side wall that is arranged at 90 degrees with respect to each attaching spring, to be positioned between the pair of attaching springs. The lighting apparatus is put into a recessed hole of the ceiling, the attaching spring lifts the lighting apparatus to make the annular flange contact to the ceiling, and thus the lighting apparatus is recessed into the ceiling. The lighting apparatus according to Patent Document 1 described above includes a radiator fin at a recessed site and a baffle made of synthetic resin at a site within the room. Thus, the heat coming from the light source is generally transferred to the radiator fin and discharged to the air within the ceiling.

Patent Document 1: Japanese Patent Application Laid-Open No. 2009-64636

SUMMARY OF THE INVENTION

A heat insulator may be utilized under the law for the ceiling of a building in which a recessed lighting apparatus is recessed, especially in cold climates. For example, "Guidelines on Design and Construction concerning the Rational Use of Energy related to Houses" based on Japanese energy conservation law states that "a recessed lighting apparatus to be attached to the ceiling or roof having heat insulated structure should be covered by a heat insulation material". In other words, a recessed lighting apparatus to be attached to the ceiling having heat insulated structure is expected to have a proper heat discharge characteristic even while covered by the heat insulation material.

When the lighting apparatus according to Patent Document 1 is applied to the ceiling having the heat insulated structure, heat discharging portions, such as the radiator fin and top wall, are covered by the heat insulation material. Thus, it is difficult to cool the lighting apparatus by convection of the radiator fin. Because the heat insulation material has relatively large heat resistance, the heat coming from the light source is hardly transferred from the heat insulation material to the air around the lighting apparatus. Hence, the temperature of the light source is increased. Especially in the case that a light emitting diode (i.e., LED) is utilized as the light source, several problems may be caused in response to the increase in LED's temperature. For example, the life of LED is shortened, enough lightness cannot be obtained due to the decrease of luminous efficiency, color temperature is changed, or the like.

In addition, an electric wire (e.g., electric power line) externally supplying power through the terminal block to the power supply device is generally a single wire, has a relatively large diameter, and has a relatively strong rigidity. When the lighting apparatus is just installed and/or wired, the stress caused by the deflected electric wire acts on the lighting apparatus. The lighting apparatus of Patent Document 1 includes two attaching springs, and the terminal block is positioned between the pair of attaching springs as described above.

Thus, a force in a direction perpendicular to the line connecting the attaching springs may act on the lighting apparatus from the electric wire, possibly causing the lighting apparatus to be off-balanced. For example, when the lighting apparatus leans, a gap is generated between the room side recessed hole opened on the ceiling and the lighting apparatus. Thus, it may cause deterioration in the appearance of the installed lighting apparatus, the air tightness of the installed lighting apparatus, and the strength of the attachment to the ceiling.

The present invention is made in view of such circumstances, and has an object to provide a lighting apparatus that can keep an improved heat discharge characteristic toward room inside and can keep stable installation condition.

A lighting apparatus according to the present invention is recessed in and attached to an attaching hole opened on a mounted portion, such as a ceiling, and has a light source and a radiator radiating a heat coming from the light source, wherein at least one part of the radiator is exposed from the attaching hole to a side where light is emitted from the light source.

According to the present invention, at least one part of the radiator radiating heat coming from the light source is exposed from the attaching hole, into which the lighting apparatus is recessed and attached, to the side where the light from the light source is emitted. When the lighting apparatus is installed to the ceiling that does not have the heat insulated structure, the radiation can be performed not only from another part of the radiator toward air inside the ceiling, but also from said one part toward air at a side (e.g., inside the room) where the light from the light source is emitted from the attaching hole. When the lighting apparatus is installed to the ceiling that has the heat insulated structure, the heat transferred from the light source to the radiator can be transferred from said one part through inside the radiator toward air at a side (e.g., inside the room) where the light from the light source is emitted from the attaching hole. Therefore, it is possible to improve the radiation performance, because the heat generated by the light source can be efficiently radiated from the attaching hole of the room and the like toward the air at a side where the light from the light source is emitted.

A lighting apparatus according to the present invention comprises a flange provided on a part of the radiator, and the flange is included in said part.

According to the present invention, the radiator includes the flange at the part of the radiator, and the flange is included in said one part. By properly forming the flange exposed from the attaching hole to the side where the light from the light source is emitted, it is possible to surely keep the radiating area, and to efficiently radiate the heat generated by the light source from the attaching hole of the room and the like to the air at the side where the light from the light source is emitted. Therefore, the radiation performance can be improved.

A lighting apparatus according to the present invention comprises the light source that is arranged on the radiator, and the light source is positioned at an exposed side.

According to the present invention, the light source is arranged on the radiator at the side of opening of the attaching hole. For example, in the case of recessed lighting apparatus whose main body is partially or totally recessed and installed into the attaching hole, the light source is positioned at the opening side but not the back side, viewed from the center of the main body in the depth direction of the attaching hole. Thus, it is possible to shorten the heat transferring path from the position where the light source is arranged on the radiator to the position of said one part exposed closer to the light emitted side than the attaching hole. Hence, the heat generated by the light source is efficiently transferred to said one part, and is radiated from said one part to the air at the side where the light from the light source is emitted from the attaching hole of the room or the like. Therefore, the radiation performance is further improved.

A lighting apparatus according to the present invention comprises the radiator that comprises a cylinder and a plate portion, wherein the flange is arranged at one side of the cylinder, the plate portion is arranged at said one side of the cylinder and separates an inside of the cylinder, and the light source is arranged on a surface at said one side of the plate portion.

According to the present invention, the plate portion separating inside of the cylinder of the radiator is arranged at one side where the flange is arranged, and the light source is arranged on the surface at said one side. It is possible not only to shorten the heat transferring path from the plate portion on which the light source is arranged to said one part exposed to the light emitted side, but also to surely keep a cross-section area in which the heat is transferred between the plate portion and the cylinder, and between the cylinder and the flange. Thus, the heat generated by the light source is efficiently transferred to flange, and is radiated from the flange to the air at the side where the light from the light source is emitted from the attaching hole of the room or the like. Therefore, the radiation performance is improved.

A lighting apparatus according to the present invention comprises: a power supply unit that is accommodated in the cylinder, and drives the light source; and a support material that supports the power supply unit in the cylinder, wherein the support material is thermally connected to a side of the flange of the radiator.

According to the present invention, the power supply unit driving the light source is attached by the support material in the cylinder of the radiator, and the support material is thermally connected to the exposed portion side of the radiator. The heat generated by electronic components of the power supply unit is transferred through the support material to the exposed portion that is exposed to the side where the light from the light source is emitted from the attaching hole. Thus, the heat can be radiated from the exposed portion to the air at the side where the light from the light source is emitted from the attaching hole of the room or the like. Therefore, the radiation performance is improved.

A lighting apparatus according to the present invention comprises: a lighting apparatus main body that has a terminal block connected to an electric wire sending a signal and or an electric wire supplying power to the light source; and plural mounting members that are provided to the lighting apparatus main body and mounts the lighting apparatus to the mounted portion, wherein the terminal block is opposed to at least one of the plural mounting members.

According to the present invention, the terminal block connected to the electric wire is arranged to be opposed to at least one of plural mounting members. When the lighting apparatus is just installed and/or wired and the stress caused by the deflected electric wire acts on the main body of the lighting apparatus, the mounting member opposed to the terminal block generates force in response to the stress, and the force in a direction substantially opposite to the direction of the stress acts on the main body of the lighting apparatus. Thus, it is possible to improve the stability of the installed lighting apparatus, and to prevent the lighting apparatus installed in the attachment hole on the ceiling from leaning and being over-inserted into the attaching hole. Therefore, it is possible to smoothly discharge the heat from the main body of the lighting apparatus to the room inside, and to avoid reduction in the radiation performance.

A lighting apparatus according to the present invention comprises a connecting direction of the electric wire to the terminal block that substantially matches with a direction from the terminal block to the mounting member that is arranged on and opposed to the terminal block.

According to the present invention, the direction of electric wire connected to the terminal block substantially matches to the direction from the terminal block to the mounting member opposed to the terminal block. When the lighting apparatus is just installed and/or wired and the stress caused by the deflected electric wire acts on the main body of the lighting apparatus, the mounting member opposed to the terminal block generates force in response to the stress, and the force in a direction substantially opposite to the direction of the stress acts on the main body of the lighting apparatus. Thus, it is possible to improve the stability of the installed lighting apparatus, and to avoid reduction in the radiation performance.

A lighting apparatus according to the present invention comprises the terminal block that is configured with plural terminal blocks, in which plural electric wires having different rigidities are connected respectively, and a terminal block having a higher rigidity among the plural terminal blocks is arranged farther away from the mounted portion.

According to the present invention, the terminal block connected to the electric wires having the higher rigidity among the plural electric wire having different rigidities is arranged farther from the mounted portion. Thus, the electric wires can prevent the force acting on the main body of the lighting apparatus, for example, because the electric wire closer to the mounted portion is deflected by a larger degree even when the lighting apparatus is installed to the mounted portion after the electric wires are connected to the terminal blocks. In other words, it is possible to reduce the effect of the positional interference caused by the mounted portion, to improve the stability of the installed lighting apparatus, and to facilitate installing the lighting apparatus to the mounted portion.

A lighting apparatus according to the present invention comprises the terminal block that is a terminal block for power supply that is connected to an electric power line supplying power to the light source and/or a terminal block for dimmer control that is connected to a signal line for a dimmer control of the light source.

According to the present invention, the terminal block opposed to the mounting member is a terminal block for power supply that is connected to the electric power line supplying power to the light source and/or a terminal block for dimmer control that is connected to the signal line for the dimmer control of the light source. When the lighting apparatus is just installed and/or wired and the stress caused by the deflected electric wire, such as electric power line and the signal line, acts on the main body of the lighting apparatus, the mounting member opposed to the terminal block generates force in response to the stress, and the force in a direction substantially opposite to the direction of the stress acts on the main body of the lighting apparatus. Thus, it is possible to improve the stability of the installed lighting apparatus, and to avoid reduction in the radiation performance.

A lighting apparatus according to the present invention comprises the plural mounting members which are arranged symmetrically, except for the mounting member opposed to the terminal block.

According to the present invention, the plural mounting members, excluding the mounting member opposed to the terminal block, are arranged symmetrically. For example, the remaining mounting members are arranged symmetrically with respect to a line connecting the center of attaching hole opened at the mounted portion to the mounting member (or the middle point between two mounting members). Thus, it is possible to balance not only the force of mounting members pressing the mounted portion, but also the weight of mounting members. Therefore, it is possible to improve the stability of the installed lighting apparatus, and to avoid reduction in the radiation performance.

A lighting apparatus according to the present invention comprises the plural mounting members that are three mounting members.

According to the present invention, the improved stability of the installed lighting apparatus can be implemented by the minimum number of the mounting members, i.e., three of the mounting members. In addition, it is possible to avoid reduction in the radiation performance.

A lighting apparatus according to the present invention comprises the mounting member that is a leaf spring which presses the lighting apparatus main body to an attaching hole opened on the mounted portion to mount the lighting apparatus main body.

According to the present invention, the leaf spring is utilized as the mounting member which presses and mounts the main body of the lighting apparatus to the attaching hole opened on the mounted portion. When the stress, caused by the electric wire connected to the terminal block acts on the main body of the lighting apparatus as described above, the leaf spring generates the force in a direction substantially opposite to the direction of the stress and the force acts on the main body of the lighting apparatus. Therefore, it is possible to improve the stability of the installed lighting apparatus, and to avoid reduction in the radiation performance.

A lighting apparatus according to the present invention comprises a light source and a radiator that radiates a heat coming from the light source, wherein the radiator comprises: a cylinder that is integrated with a flange at one side of the cylinder; and a plate portion that is positioned at said one side of the cylinder and separates an inside of the cylinder, and the light source is arranged on a surface at said one side of the plate portion.

According to the present invention, for example, according to the recessed lighting apparatus partially or totally recessed in the attaching hole of the ceiling for installation, the light source is positioned at the opening side (exposing side) but not at the back side, viewed from the center of the main body in the depth direction of the attaching hole. The plate portion separating the inside of cylinder of the radiator is arranged at one side where the flange is arranged, and the light source is arranged at said one side of the plate portion. Thus, it is possible not only to shorten the heat transferring path from the plate portion on which the light source is arranged to said one part exposed to the light emitted side, but also to surely keep a cross-section area in which the heat is transferred between the plate portion and the cylinder, and between the cylinder and the flange. Hence, the heat generated by the light source is efficiently transferred to the flange, and is radiated from the flange to the air at the side where the light from the light source is emitted from the attaching hole of the room or the like. Therefore, the radiation performance is improved.

In the present invention, the radiation performance into the room can be improved and the stable installed condition can be kept.

The above and further objects and features of the invention will more fully be apparent from the following detailed description with accompanying drawings.

DESCRIPTION OF THE PREFERRED EMBODIMENTS

Figure 1:
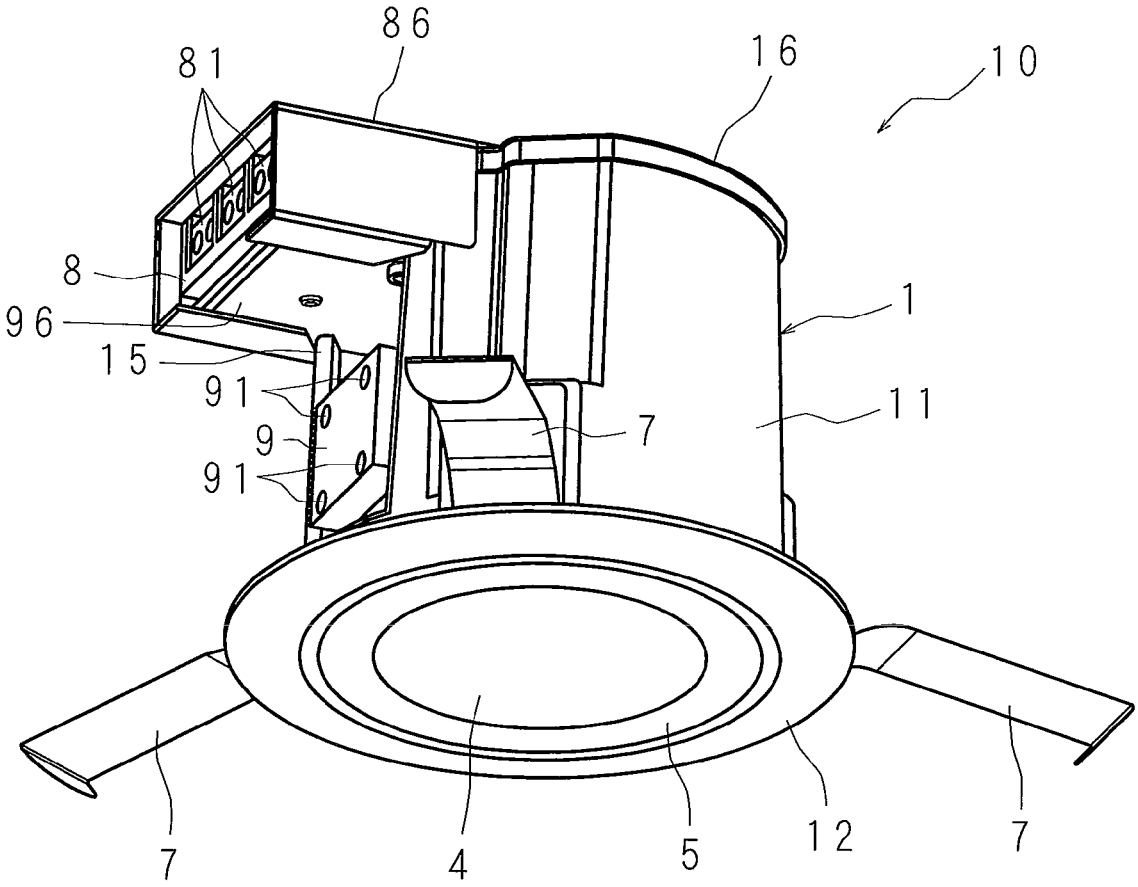
FIG. 1 is a perspective view showing an appearance of the lighting apparatus according to the present invention.
Figure 2:
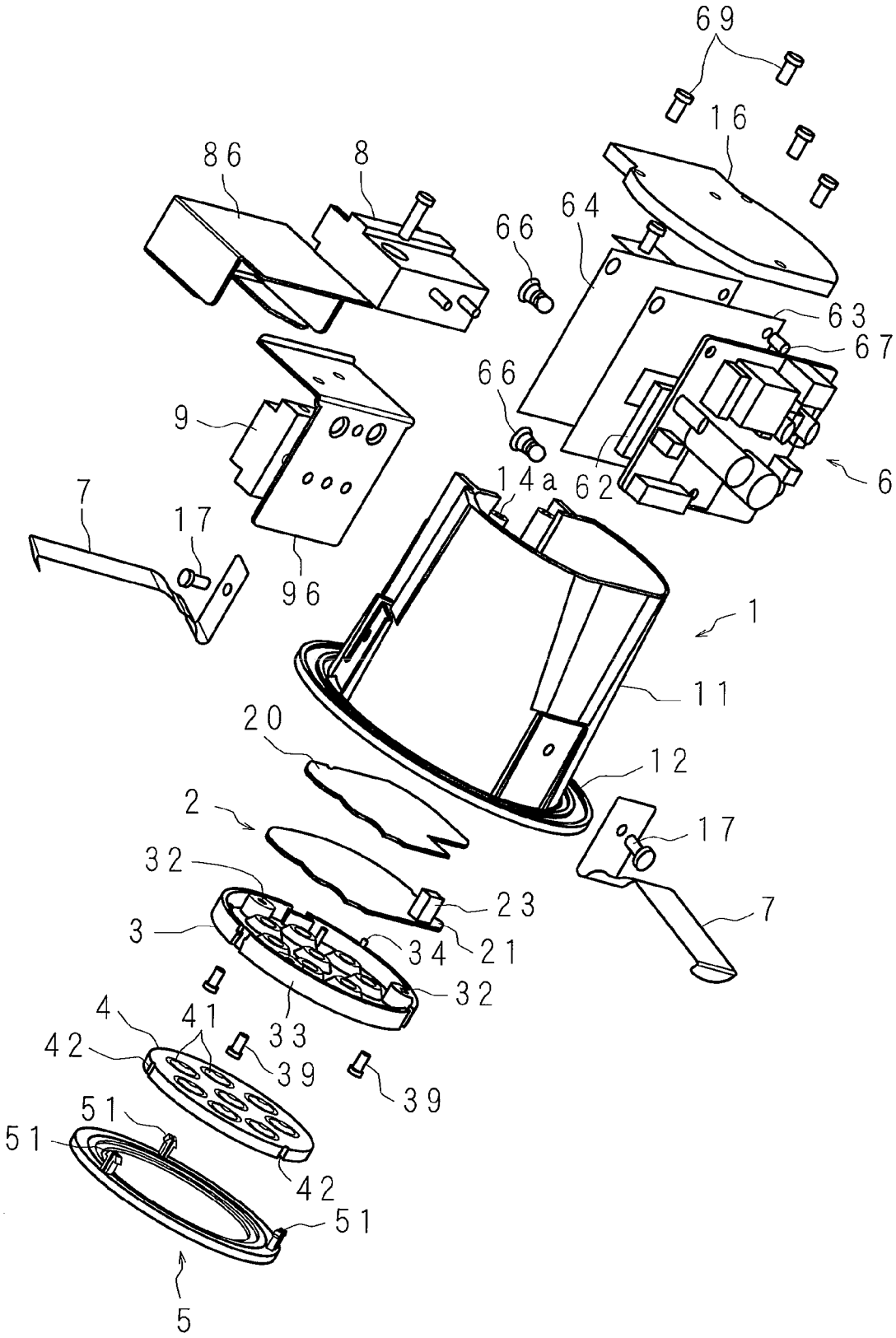
FIG. 2 is a perspective view schematically showing the exploded lighting apparatus according to the present invention.
Figure 3:
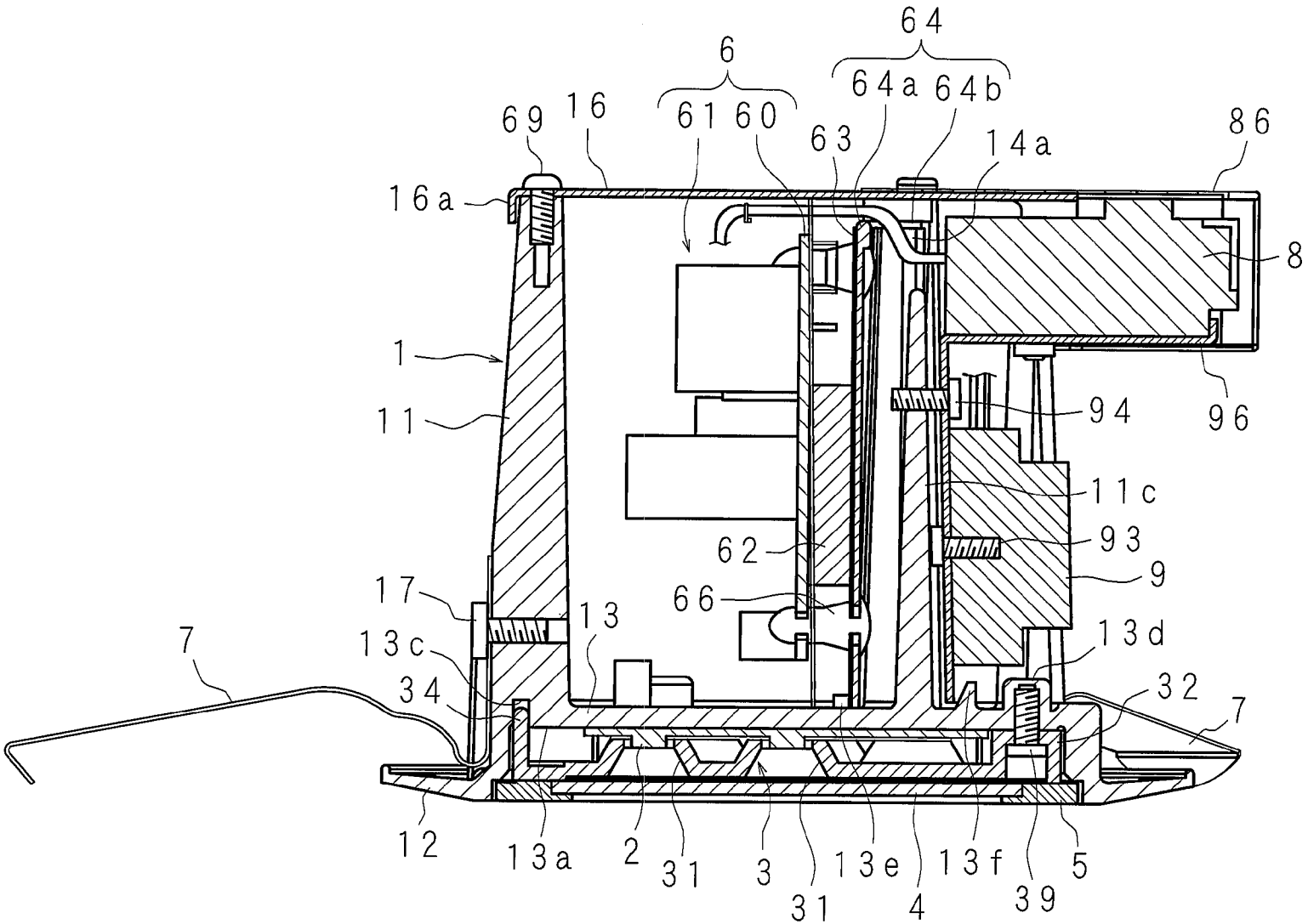
FIG. 3 is a schematic cross-section view showing the lighting apparatus according to the present invention.

The present invention will be described below in reference to figures that show Embodiments according to the present invention. FIG. 1 is a perspective view showing an appearance of the lighting apparatus according to the present invention. FIG. 2 is a perspective view schematically showing the exploded lighting apparatus according to the present invention. FIG. 3 is a schematic cross-section view showing the lighting apparatus according to the present invention. It should be noted that the lighting apparatus is explained in the context of a downlight which is a recessed lighting apparatus partially or totally recessed into an attaching hole.

Figure 4:
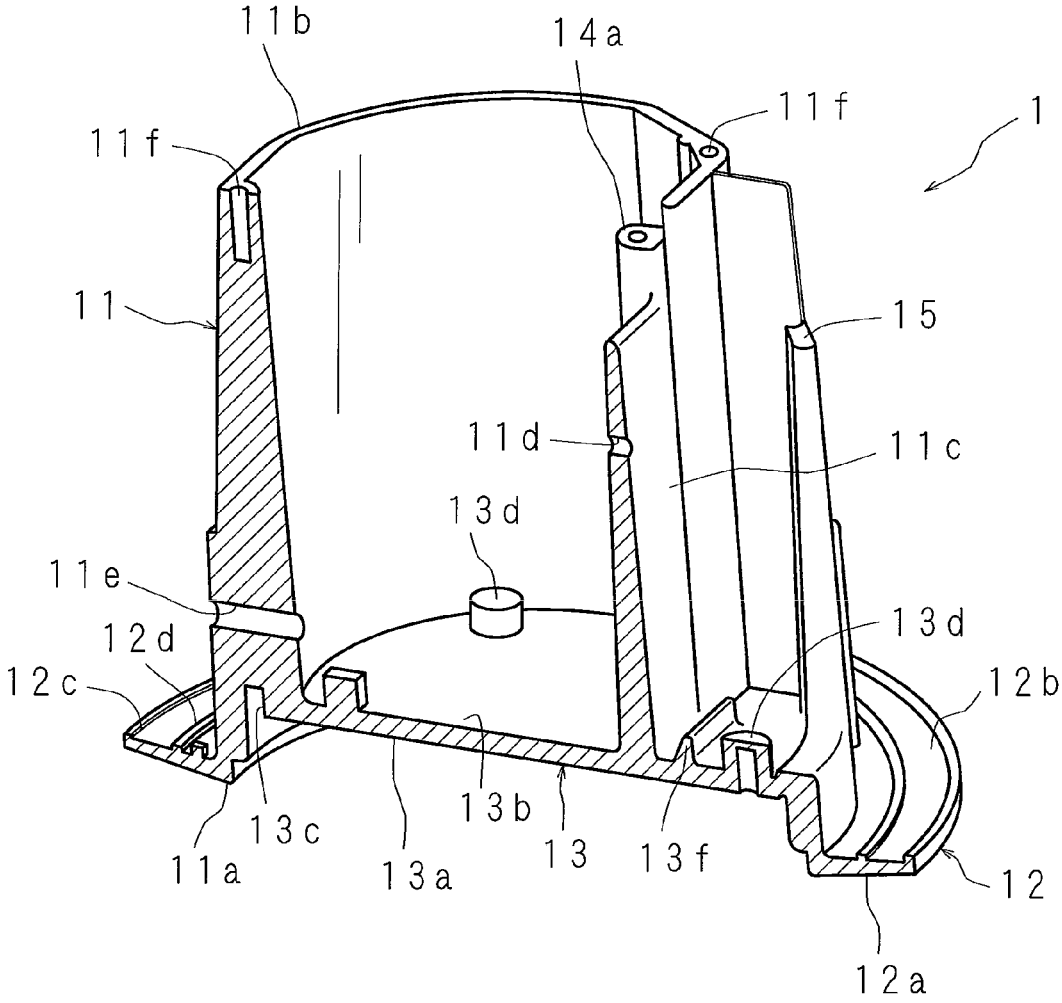
FIG. 4 is a perspective view schematically showing a cross-section of a heat sink.
Figure 5:
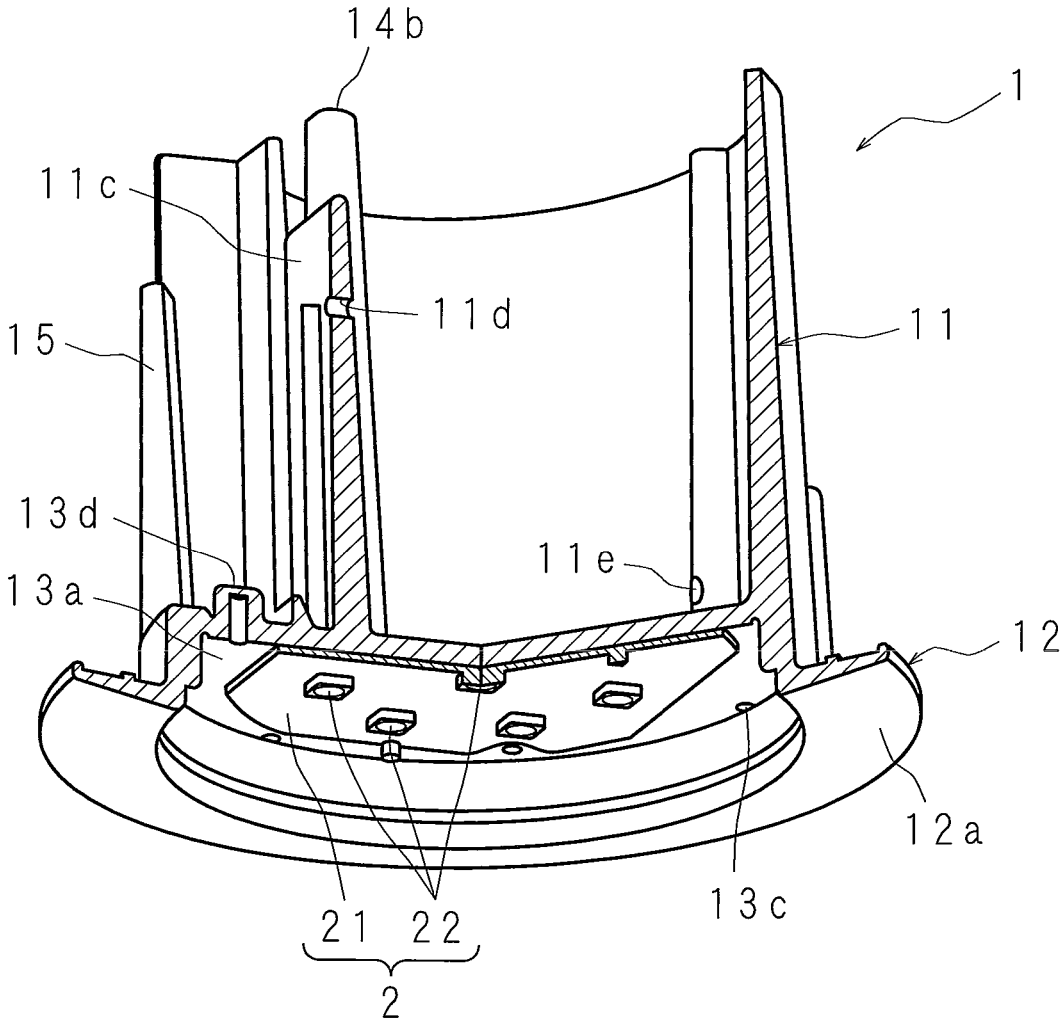
FIG. 5 is a perspective view schematically showing another cross-section of the heat sink.

The numeral "1" in figures indicates a heat sink made of metal, such as aluminum. The heat sink 1 includes a cylinder 11 formed in a cylindrical shape, and a flange 12 arranged on an outer peripheral surface at a side of one end 11*a* of the cylinder 11. FIG. 4 is a perspective view schematically showing a cross-section of the heat sink 1, in which the heat sink 1 is viewed from a side of another end 11*b*. FIG. 5 is a perspective view schematically showing another cross-section of the heat sink 1, in which the heat sink 1 is viewed from the side of one end 11*a* of the cylinder 11. For example, the heat sink 1 is integrally formed by aluminum die casting.

The cylinder 11 includes a terminal block fixing unit 11*c* described later, and the terminal block fixing unit 11*c* is formed in a plain plate shape by making an inward recess (whose width is shorter than the radius of the cylinder 11 by a predetermined length) on a part of a peripheral wall of the cylinder 11 at a side of a power source accommodating portion. A direction of a perpendicular line passing through the center of cylinder 11 to the terminal block fixing unit 11*c* corresponds to the radial direction of the cylinder 11. Regarding the predetermined length, the terminal block fixing unit 11*c* is configured to be positioned more inward than the maximum external diameter of the cylinder 11.

The flange 12 is formed in a disc shape whose center is opened. A surface 12*a* of the flange 12 at the side opposite the cylinder 11 side is configured to gradually incline toward the outside. Another surface 12*b* of the flange 12 at the cylinder 11 side is configured to be substantially horizontal. A covered portion 12*c* is arranged at the peripheral edge on said another surface 12*b*, such as a lib formed in a flat and cylindrical shape, which is perpendicular to said another surface 12*b*, parallel to the cylinder 11 and protruding along the entire periphery of said another surface 12*b*. The covered portion 12*c* is utilized for covering a gap between the main body of the lighting apparatus and the mounted portion which may be caused by a concavity and convexity of the attaching hole opened at the mounted portion, such as a burr. A protruding portion 12*d* is arranged at the peripheral edge on another surface 12*b* of the flange 12, which is formed in a flat and cylindrical shape, concentric to the covered portion 12*c*, perpendicular to said another surface 12*b* and protruding along the entire periphery of said another surface 12*b*. A packing is inserted between the covered portion 12*c* and the protruding portion 12*d*, which is made of elastic synthetic resin, for example, rubber. Thus, it is possible to install the lighting apparatus to the attaching hole with the flange 12 surely in contact with the mounted portion, such as the ceiling.

The cylinder 11 of the heat sink 1 includes a heat exchanger plate 13 at the side of one end 11*a*, which separates the inside of cylinder 11 into two rooms: a power source accommodating portion in which a power supply unit described later is accommodated; and a light source accommodating portion whose diameter is larger than the diameter of the power source accommodating portion and in which a light source unit is accommodated. The heat exchanger plate 13 is arranged close to the flange 12, as shown in figures. It may be preferable that the heat exchanger plate 13 is arranged as close as possible to the outside of the attaching hole, i.e., the side of the room where the light from the light source unit is emitted from the attaching hole, in the case that the downlight is installed at the attaching hole opened on the ceiling.

The light source unit 2 is arranged via a heat transferring sheet 20 on the surface 13*a* opposite to the side of one end 11*a* of the heat exchanger plate 13 of the heat sink 1. The light source unit 2 includes: a LED board 21 formed in a rectangular plate shape; plural LEDs 22, 22, . . . mounted on the LED board 21; and a connector 23 that is arranged on a surface of LED board 21 opposite to the surface on which the LEDs 22, 22, . . . are mounted and is illustrated by a rectangular column in FIG. 2. In this embodiment, the number of LEDs is eight and one LED 22 of them is mounted at the center of LED board 21 as shown in FIG. 5. The remaining seven LEDs 22, 22, . . . are arranged around the center LED 22 in the circumferential direction and separated from each other by proper distances. The LED 22 is, for example, a surface mounted type LED which includes a LED element, a sealing resin that seals the LED element, an input terminal and an output terminal. The heat transferring sheet 20 is a heat conductor having an insulation property. For example, the heat transferring sheet 20 is made of silicon based resin including an appropriate amount of metal oxide as the filler.

The heat exchanger plate 13 includes plural engaging hole portions 13*c* on one surface 13*a*, which is engaged with engaging protrusions of a reflector described later. In addition, the heat exchanger plate 13 includes plural boss portions 13*d*, each of which is provided with a screw hole. Two convexes 13*e* are arranged on another surface 13*b* of the heat exchanger plate 13 inside the cylinder 11, which are parallel to the terminal block fixing unit 11*c*. A convex 13*f* is arranged on said another surface 13*b* of the heat exchanger plate 13 outside the cylinder 11, which is parallel to the terminal block fixing unit 11*c*.

In addition, two boss portions 14*a*, 14*b* are arranged to stand on said another surface 13*b* of the heat exchanger plate 13 inside the cylinder 11, each of which is connected to the terminal block fixing unit 11*c* and is provided with a screw hole. Angle support portions 15, 15 are arranged to stand on said another surface 13*b* of the heat exchanger plate 13 outside the cylinder 11, each of which is positioned away from and opposed to the terminal block fixing unit 11*c* and is utilized for supporting a terminal block support angle described later.

The terminal block fixing unit 11*c* includes a screw hole 11*d* for fixing the terminal block support angle. In addition, the cylinder 11 includes plural screw holes 11*e* spaced apart at even distances in the circumferential direction for fixing a leaf spring described later. Further plural screw holes 11*f* are provided on said another end 11*b* of the cylinder 11 for fixing a cover described later.

A reflection plate 3 is arranged on said one surface 13*a* of the heat exchanger plate 13 of the heat sink 1 described above. The reflection plate 3 includes plural reflection units 31, 31, . . . at positions corresponding to the LEDs 22, 22, . . . when the reflection plate 3 is attached to the heat sink 1, to surround the LEDs 22, 22, . . . . The reflection unit 31 is formed in a substantial hemisphere shape having a concave portion. The reflection plate 3 is made of electrical insulation material having a high reflectivity, such as polycarbonate resin or alumina sintered body.

Plural fixing portions 32 are provided to the reflection plate 3 at positions corresponding to plural boss portions 13*d* of the heat exchanger plate 13 when the reflection plate 3 is attached to the heat sink 1. The fixing portion 32 is formed in a substantial column shape having a concave portion. In addition, a peripheral wall 33 is arranged to stand on the periphery of reflection plate 3, and plural first engaging protrusions 34 are arranged to stand on an end surface of the peripheral wall 33. The first engaging protrusion 34 is formed in a column shape to match with the engaging hole portion 13*c*.

While the first engaging protrusion 34 is engaged into the engaging hole portion 13*c* of the heat sink 1, the end surface of peripheral wall 33 is made in contact with the heat exchanger plate 13, screws 39, 39 . . . are inserted into through holes provided to the fixing portions 32, 32 . . . of the reflection plate 3, and then screws 39, 39 . . . are screwed into the screw holes provided at the boss portions 13*d* of the heat exchanger plate 13, in order to fix the reflection plate 3 to the heat sink 1. The reflection units 31, 31, . . . can be arranged at the positions corresponding to the LEDs 22, 22 . . . by a simple effort for engaging the first engaging protrusion 34 of the reflection plate 3 with the engaging hole portion 13*c* of the heat sink 1.

The lights emitted respectively from LEDs 22, 22 . . . of the light source unit 2 are reflected by the reflection units 31, 31 . . . , and the angle formed by the reflected light and the each light axis of LEDs 22, 22 . . . falls in a range of a predetermined degree or lower. Thus, the light apparatus can emit light whose distribution is controlled to increase the illuminance underneath the lighting apparatus.

Figure 6:
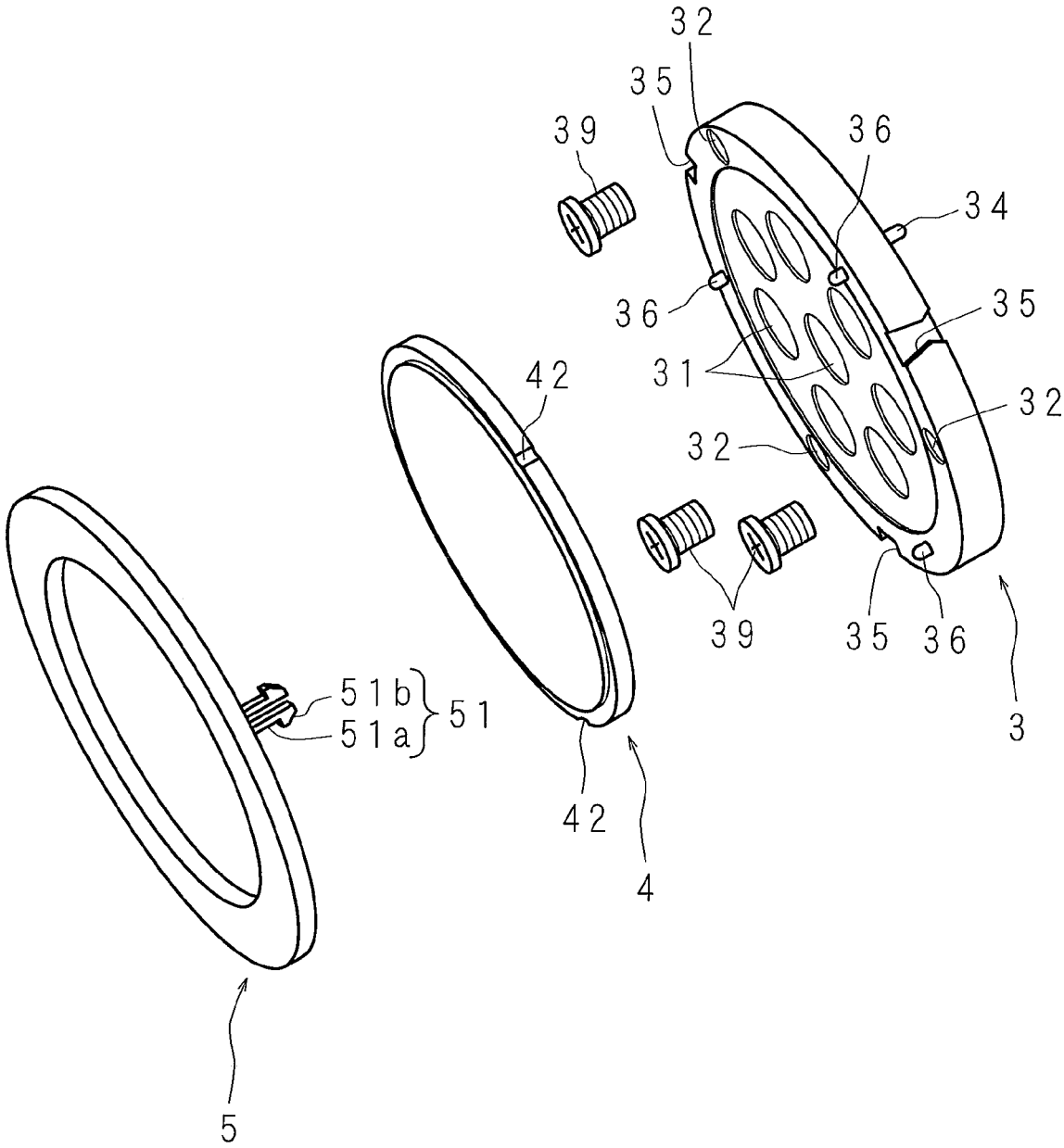
FIG. 6 is a perspective view showing appearances of a reflection plate, a translucent plate and a decorative rim.
Figure 7:
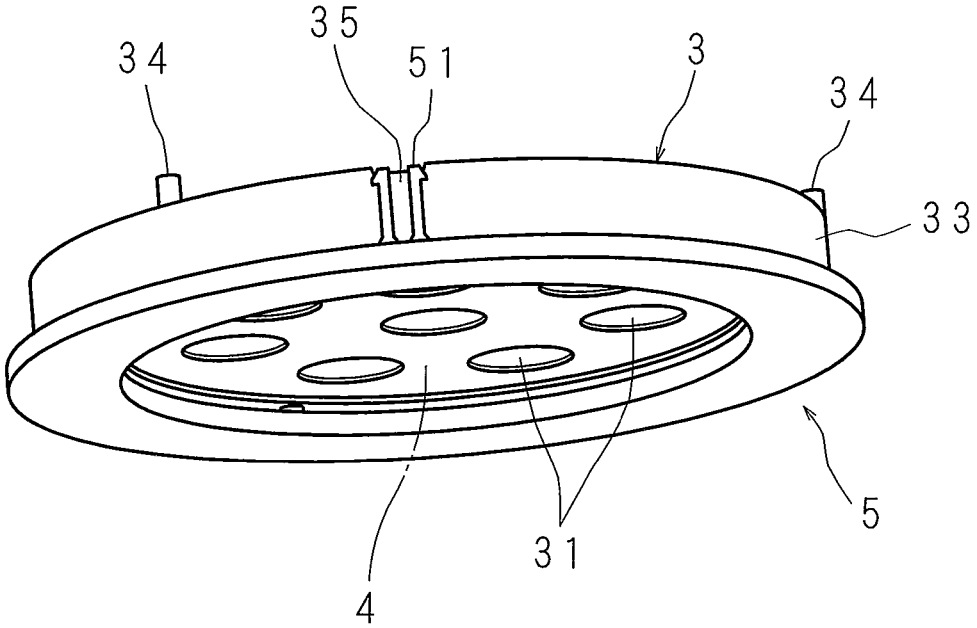
FIG. 7 is a perspective view showing an appearance in which the reflection plate, the translucent plate and the decorative rim are attached to each other.

A decorative rim 5 is arranged on the reflection plate 3, and a translucent plate 4 is disposed between the reflection plate 3 and the decorative rim 5. FIG. 6 is a perspective view showing appearances of the reflection plate 3, the translucent plate 4 and the decorative rim 5. FIG. 7 is a perspective view showing an appearance in which the reflection plate 3, the translucent plate 4 and the decorative rim 5 are attached to each other.

As shown in FIG. 6, plural (three in figures) engaging concave portions 35, 35 . . . are provided and spaced apart by proper distances in the circumferential direction on the outer surface of peripheral wall 33 of the reflection plate 3. In addition, plural (three in figures) second engaging protrusions 36, 36 . . . are provided and spaced apart by proper distances in the circumferential direction at the periphery of surface of the reflection plate 3 opposite to the surface on which the first engaging protrusion 34 is arranged.

The translucent plate 4 is formed in a disc shape. Convex lenses 41, 41 are provided at positions on one surface of the translucent plate 4 to match with the reflection units 31, 31 . . . of the reflection plate 3 attached to the translucent plate 4. Plural concave portions 42, 42 . . . are provided and spaced apart by proper distances in the circumferential direction on the outer peripheral surface of the translucent plate 4. Although this embodiment is illustrated to include the translucent plate 4 provided with lenses on one surface, the present invention is not limited to the illustration. It is possible to utilize a translucent plate having no lens. For example, the translucent plate 4 may be made of polycarbonate resin, acryl resin, glass or the like. It is further desirable to utilize resin with which-injection molding can be performed.

The decorative rim 5 is formed in a disc shape whose center is opened. Plural (three in figures) engaging portions 51, 51 . . . are arranged and spaced apart in the circumferential direction by proper distances at the periphery on one surface of the decorative rim 5. The engaging portion 51 is configured with two elastically deformable support pieces 51*a*, 51*a* and two engaging claws 51*b*, 51*b*. The engaging claws 51*b*, 51*b* are arranged respectively on end portions of support pieces 51*a*, 51*a* to protrude toward opposite directions from each other. The decorative rim 5 is made of resin, such as polycarbonate resin.

The convex portions 42, 42 of translucent plate 4 is engaged with the second engaging protrusions 36, 36 . . . of the reflection plate 3, to align the translucent plate 4 on the reflection plate 3. The lenses 41, 41 . . . of the translucent plate 4 can be aligned with the reflection units 31, 31 . . . , in other words, can be positioned to places corresponding to the places of LEDs 22, 22 . . . , by simply engaging the second engaging protrusion 36 of the reflection plate 3 with the concave portion 42 of the translucent plate 4. The reflection plate 3, the translucent plate 4 and the decorative rim 5 are integrated as shown in FIG. 7, by engaging the engaging portions 51, 51 . . . of decorative rim 5 with the engaging concave portions 35, 35 . . . of the reflection plate 3 in the condition described above. The translucent plate 4 is pressed toward the reflection plate 3 by the decorative rim 5, to be disposed between the reflection plate 3 and the decorative rim 5. Since the engagement allows them attachable and detachable, it is possible not only to easily attach and detach them, but also to reduce the number of components because components, such as screws, can be removed.

The second engaging protrusion 36 of the reflection plate 3 and concave portion 42 of the translucent plate 3 are positioned properly in the circumferential direction, and thus the translucent plate 4 can be attached to the reflecting plate 3 at only one position in the circumferential direction. In other words, the distances of engaging protrusions 36, 36 . . . engaging protrusions 36, 36 . . . are spaced away from each other in the circumferential direction at irregular distances. The distances of concave portions 42, 42 . . . are also not equal. It is important to align each center of LEDs 22, 22, . . . and each center of lenses 41, 41, . . . (align the light axes) for obtaining light in a predetermined direction. Even in the case that the LEDs 22, 22 . . . are not arranged at regular distances in the circumferential direction as illustrated in this embodiment, it is possible to easily adjust the positions and to obtain desired light, because the positions of LEDs 22, 22 . . . , the reflection units 31, 31 . . . and the lenses 41, 41 . . . can be aligned with one another by the engagement in the configurations described above.

Figure 8:
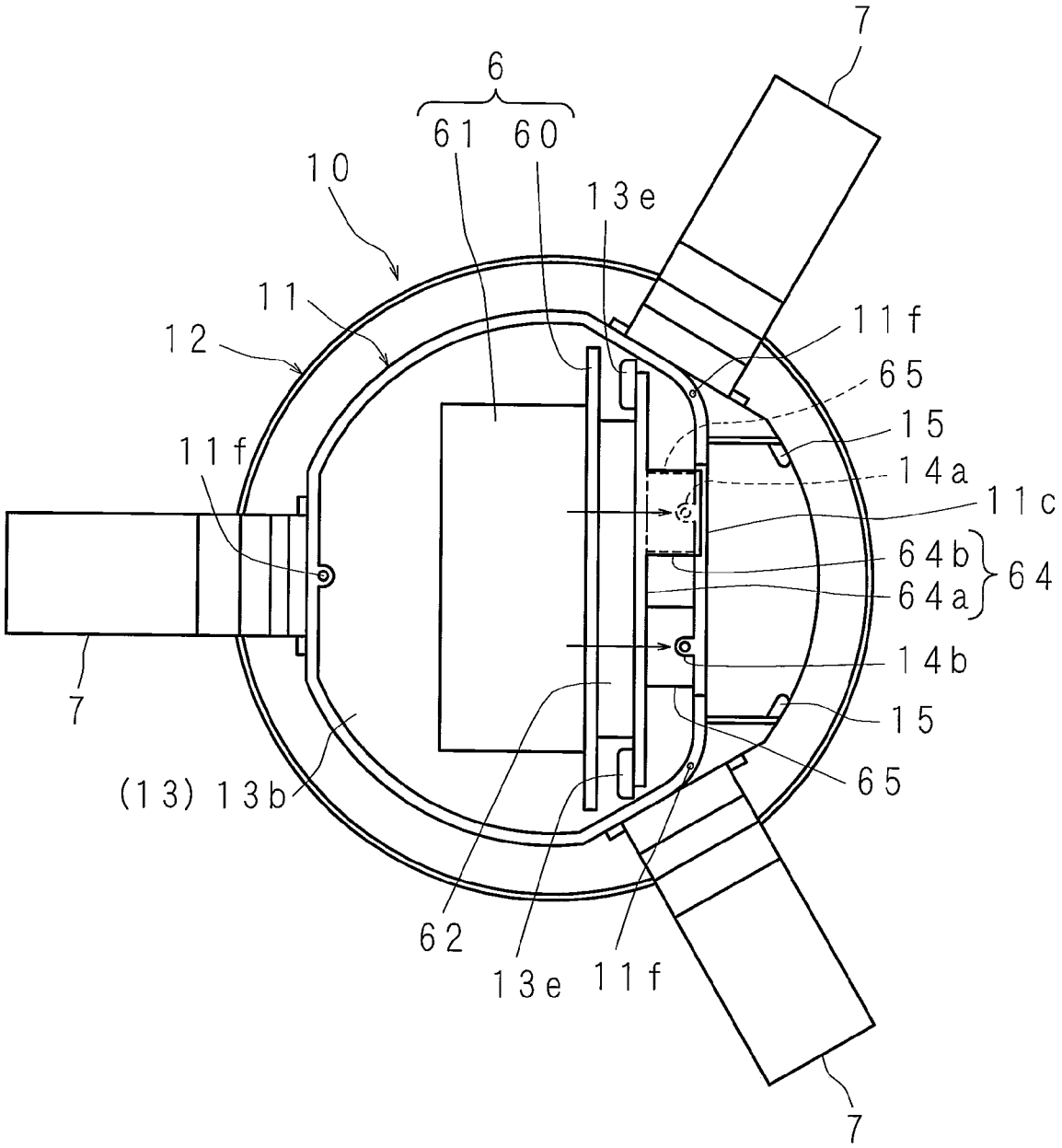
FIG. 8 is a schematic view showing an arrangement of a power supply unit in a cylinder.

The power supply unit 6 is accommodated at the side of said another surface 13*b* of the heat exchanger plate 13 included by the cylinder 11 of the heat sink 1, as shown in FIG. 3. The power supply unit 6 includes a circuit board 60 that is configured in a rectangular plate shape and an electronic component 61 that is mounted on the circuit board 60. Although schematically illustrated in figures by a rectangular block, the electronic component 61 consists of several circuit components, such as a transformer, a resistor and a capacitor. FIG. 8 is a schematic view showing an arrangement of the power supply unit 6 in the cylinder 11.

The power supply unit 6 is arranged on the support plate 64 via a heat transferring sheet 62 and an insulation sheet 63. The support plate 64 includes a fixing plate portion 64*a* that is formed in a rectangular plate shape and an attaching plate portion 64*b* that is arranged on a part at the periphery of fixing plate portion 64*a* and formed in a rectangular plate shape. The support plate 64 is made of metal, such as iron. Plural through holes are formed on the circuit board 60 and the fixing plate portion 64*a*. A spacer 66 is inserted into the through hole, and thus it is possible to integrate the power supply unit 6, the heat transferring sheet 62, the insulation sheet 63 and the support plate 64 spaced apart by a predetermined distances, as shown in FIG. 3. The spacer 66 is made of polyester resin (for example, polybutylene terephthalate: PBT) or polyamide resin (for example, nylon), and includes plural engaging claws in the circumferential direction which are arranged in two steps. The fixing plate portion 64*a* of the support plate 64 is fixed to the first step of the spacer 66, and the circuit board 60 is fixed to the second step of the spacer 66. Assembling can be performed easily by inserting the spacer 66 from the side of fixing plate portion 64*a*. In addition, a cylindrical spacer 67 is disposed between the circuit board 60 and the insulation sheet 63. The spacer 67 is made of metal, such as iron, and utilized for surely keeping a space where a screw making the circuit board 60 in contact with the earth is fixed to the circuit board 60.

The insulation sheet 63 is, for example, a sheet made of modified polyethylene whose thickness is 0.4 mm, and is arranged for surely insulating the solder surface of the circuit board 60 from the support plate 64. In addition, an opening is provided to a portion of the insulation sheet 63 that is in contact with the heat transferring sheet 62, which is a little smaller than the heat transferring sheet 62, in order to improve the performance of heat transfer toward the support plate 64.

The heat transferring sheet 62 is formed in a thick rectangular plate shape whose area is smaller than the circuit board 60. The insulation sheet 63 is formed in a rectangular plate shape similar to the support plate 64. The heat transferring sheet 62 is arranged at the position where a component having a higher heating value is arranged among the electronic component 61 mounted on the circuit board 60. The size of heat transferring sheet 62 is defined to optimize the heat transferring performance, in view of the heat transfer caused by the heat transferring sheet 62, by the radiation from the power supply unit 6 and the like. This embodiment is an example in which the component having a higher heating value among the electronic components 61 is arranged at the substantial center of the circuit board 60.

One boss portion 14*a* of the heat sink 1 is fixed to the support plate 64 to which the power supply unit 6 is attached as described above. Thick heat transferring sheets 65, 65 are arranged on a surface of support plate 64 closer to the boss portions 14*a*, 14*b*. The heat transferring sheets 65, 65 are previously applied to the support plate 64. When the support plate 64 is inserted and attached into the heat sink 1, the heat transferring sheets 65, 65 becomes in contact with the boss portions 14*a*, 14*b*. One end of fixing plate portion 64*a* is engaged with the convex 13*e* on said another surface 13*b* of the heat exchanger plate 13, and the screw 69 (see FIG. 2) is inserted into the through hole of the attaching plate portion 64*b* and then screwed into the screw hole of the boss portion 14*a*, to fix the support plate 64 to the heat sink 1. In this fixed situation, each of the heat transferring sheets 62, 65 is disposed without a gap between parts. Thus, the heat generated by the electronic component 61 of the power supply unit 6 is mainly transferred to the heat sink 1 through the circuit board 60, the heat transferring sheet 62, fixing plate portion 64*a* of the support plate 64, the heat transferring sheet 65 and the boss portions 14*a*, 14*b*. The heat transferring sheets 62, 65 are heat conductors having insulation properties. For example, the heat transferring sheets 62, 65 are made of silicon-based resin including an appropriate amount of metal oxide as the filler. Although arranged at the positions in contact with both of the boss portions 14*a*, 14*b* in this embodiment, the heat transferring sheets 65, 65 may alternatively be arranged at the positions contacting with one of the boss portions 14*a*, 14*b*. It should be noted that the heat transferring sheets 65, 65 should be contacted to both of the boss portions 14*a*, 14*b*, in the recessed lighting apparatus applied to the ceiling having the high heat insulated structure according to the lid mat method or the blowing method. Therefore, the heat generated by the power supply unit 6 can be transferred to the heat sink 1, efficiently.

As described above, the cover 16 is attached to the end of cylinder 11 in which the power supply unit 6 is accommodated. The peripheral wall 16*a* is arranged to stand on the periphery of cover 16. The peripheral wall 16*a* is arranged along the periphery excluding a linear portion provided on the terminal block described later. Plural through holes are provided to the cover 16. The screws 69, 69 . . . are inserted into the through holes and screwed into the screw holes 11*f*, 11*f* . . . arranged on said another end lib of the cylinder 11, to fix the cover 16 to the heat sink 1.

Figure 9:
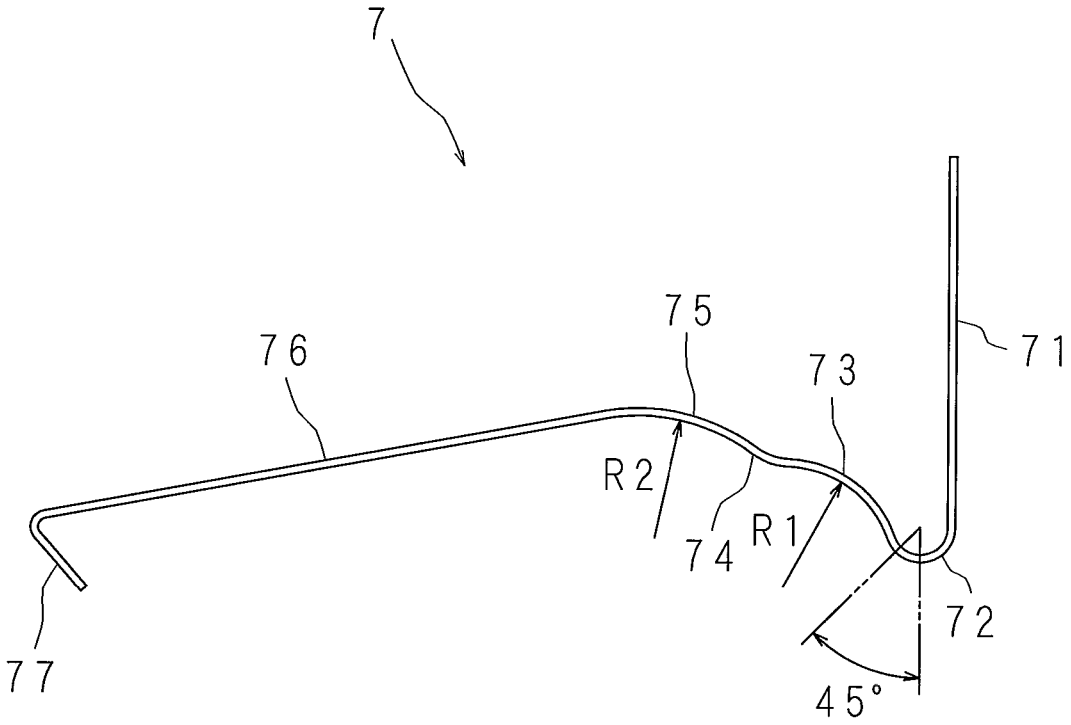
FIG. 9 is an enlarged view showing a leaf spring.

Plural leaf springs 7 are arranged, as the mounting members, on the main body 10 of lighting apparatus described above. FIG. 9 is an enlarged view showing the leaf spring. The leaf spring 7 is made of metal, such as stainless steel, and formed in a "V" shape as shown in FIG. 9 by bending an elongate rectangular plate. An attaching portion 71 is provided on one end of the leaf spring 7, which is formed in a rectangular plate shape and provided with a through hole (not shown in figures). A bending portion 72 is provided next to the attaching portion 71, which is bended about 135 degrees with a small curvature radius.

A first pressing portion 73 is provided on the other side over the bending portion 72 of the leaf spring 7, which convexly curves toward the attaching portion 71 and whose cross section in the longitudinal direction of the leaf spring 7 is formed in an arcuate shape. A convex portion 74 is provided next to the first pressing portion 73, which convexly curves toward the direction opposite to the curving direction of first pressing portion 73. A second pressing portion 75 is provided next to the convex portion 74, which convexly curves toward the same direction as the curving direction of the first pressing portion 73 and has an arcuate cross section along the longitudinal direction of the leaf spring 7. An arm portion 76 is provided next to the second pressing portion 75, which is formed in a rectangular plate shape. A dislocation preventing portion 77 is provided at the end of arm portion 76, which is bent to the side opposite to the attaching portion 71. A sharp angle is formed from dislocation preventing portion 77 through the end of arm portion 76 to the arm portion 76. The dislocation preventing portion 77 is utilized for preventing the main body of lighting apparatus 10 from falling in the case that the first pressing portion 73 and the second pressing portion 75 of the leaf spring 7 are not in contact with the ceiling.

The curvature radius of the first pressing portion 73 is different from the curvature radius of the second pressing portion 75. The curvature radius R2 of the second pressing portion 75 is larger than the curvature radius R1 of the first pressing portion 73 (R1<R2). In this embodiment, the board thickness of ceiling is estimated to be 3-9 mm or 20-25 mm where the lighting apparatus described later is installed, and thus it is determined that the curvature radius R1 of the first pressing portion 73 is 6 mm and the curvature radius R2 of the second pressing portion 75 is 23 mm. Because the curvature radius R1 of the first pressing portion 73 and the curvature radius R2 of the second pressing portion 75 are determined in consideration of the board thickness of the ceiling, only one of the first pressing portion 73 and the second pressing portion 75 will be in contact with the ceiling from the top when the lighting apparatus is installed on the ceiling. In this embodiment, the bending portion 72 is bent about 135 degrees, but not about 180 degrees, and then the next first pressing portion 73 is provided to extend from the end of the bent part. Therefore, it is possible to apply the lighting apparatus to the ceiling whose board thickness is smaller than the curvature radius R1 of the first pressing portion 73. Although this embodiment is illustrated to utilize the bending portion 72 bent about 135 degree, the present invention is not limited to the illustration. The bending angle may be properly determined in consideration of the estimated board thickness of the ceiling.

The leaf springs 7 as described above are arranged on the cylinder 11 of the heat sink 1, spaced apart by substantially equal distances in the circumferential direction of the main body 10 of lighting apparatus. The screw 17 is inserted into the through hole of the attaching portion 71 of the leaf spring 7 and screwed into the screw hole 11*e* of the cylinder 11. Thus, the leaf springs 7 are fixed to the heat sink 1, spaced apart by the same distances as shown in FIG. 8, while the attaching portion 71 of leaf spring 7 is in contact with the outer surface of the cylinder 11. Alternatively, a tapping screw may be utilized for the screw hole 11*e*, instead of the screw 17.

Figure 10:
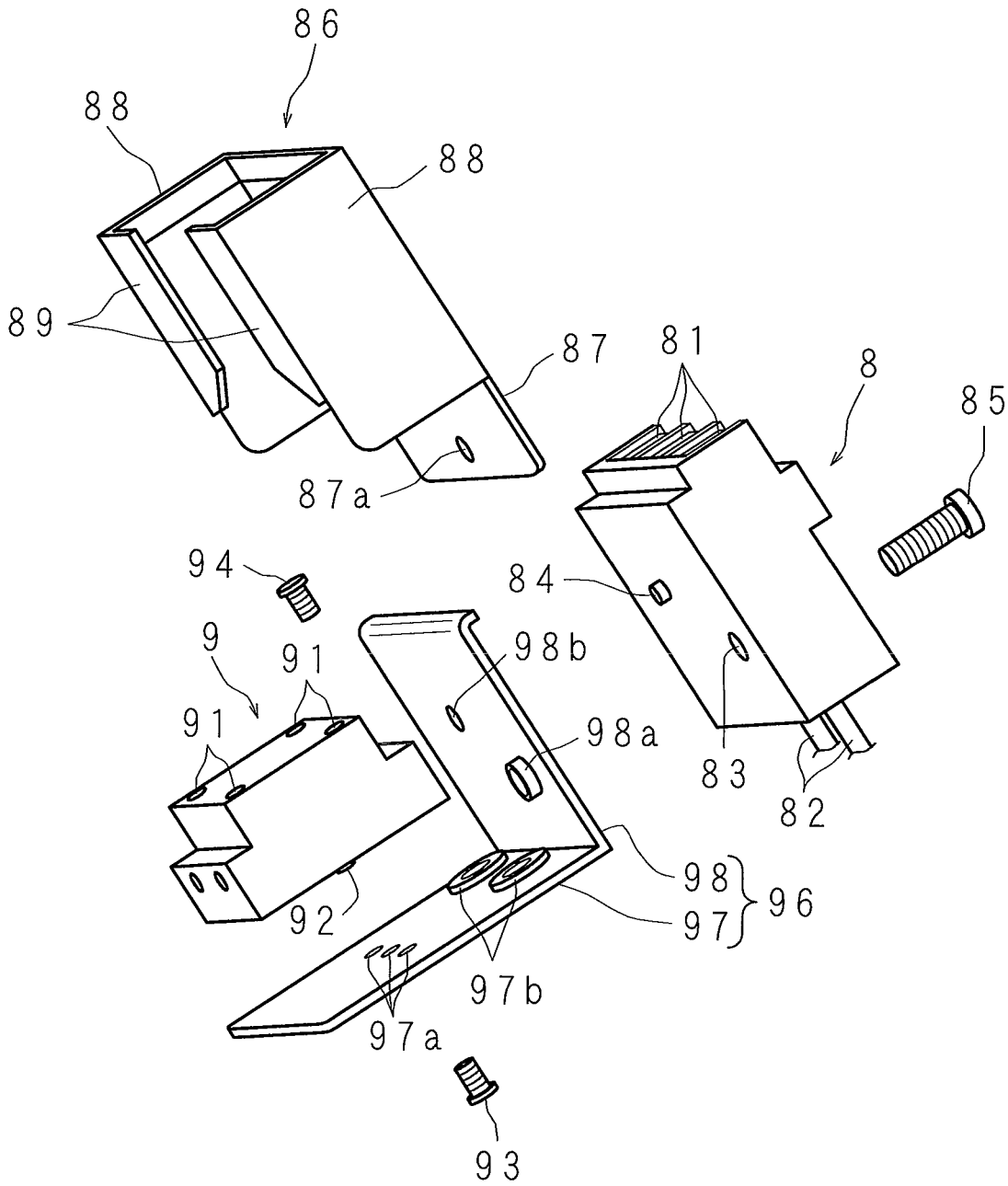
FIG. 10 is a perspective view showing appearances of a terminal block for power supply, and a terminal block for dimmer control.

In addition, the heat sink 1 is connected to terminal blocks: a terminal block for power supply 8 that is connected to power cable, i.e., electric power line supplying power to the light source unit 2 through the power supply unit 6; and a terminal block for dimmer control 9 that is connected to a signal line for the dimmer control of the light source unit 2. FIG. 10 is a perspective view showing appearances of the terminal block for power supply 8 and the terminal block for dimmer control 9.

The terminal block for power supply 8 is formed in a substantial rectangular parallelepiped having flat surfaces. Connection terminals 81, 81 . . . are arranged on one surface of the terminal block for power supply 8, which are connected to power cables. Power harnesses 82, 82 are arranged on a surface of the terminal block for power supply 8 opposite to the surface where the connection terminals are arranged, which are connected to the power supply unit 6. Through hole 83 is provided to and penetrates through another two surfaces of the terminal block for power supply 8 which are perpendicular to the two surfaces described above. A protrusion 84 is arranged on one of said another two surfaces, which is formed in a column shape and utilized for positioning.

The terminal block for dimmer control 9 is formed in a substantial rectangular parallelepiped having flat surfaces. Connection terminals 91, 91 . . . are arranged on one surface of the terminal block for dimmer control 9, which are connected to signal lines for dimmer control. Two protrusions 92 are arranged in parallel with each other on a surface of the terminal block for dimmer control 9 opposite to the surface where the connection terminals are arranged, which are formed in column shapes and utilized for positioning. A screw hole (not shown in figures) is arranged between the protrusions 92. Dimmer control lines (not shown in figures) are arranged on surfaces of the terminal block for dimmer control 9 perpendicular to the two surfaces described above, which are connected to the power supply unit 6.

The terminal block for power supply 8 and the terminal block for dimmer control 9 are attached to a terminal block support angle 96 that is formed in a "L" shape. The terminal block support angle 96 is configured with a dimmer control terminal block attaching portion 97 formed in an elongate rectangular shape and a power supply terminal block attaching portion 98 formed in a rectangular shape and provided at an end in the longitudinal direction of the dimmer control terminal block attaching portion 97. Three through holes 97*a*, 97*a* . . . are provided at the substantial center of the dimmer control terminal block attaching portion 97, which are aligned with the two columnar protrusions 92 and the screw hole on the terminal block for dimmer control 9. In addition, two insertion holes 97*b*, 97*b* are provided in parallel with each other at the side of power supply terminal block attaching portion 98 on the dimmer control terminal block attaching portion 97, into which two signal lines for dimmer control are inserted. A through hole 97*c* (see FIG. 11) is provided between these insertion holes 97*b*, 97*b*. A female screw portion 98*a* and a through hole 98*b* are provided to the power supply terminal block attaching portion 98 at the positions corresponding to the through hole 83 and the columnar protrusion 84 of the terminal block for power supply 8, respectively. The female screw portion 98*a* is formed in a cylindrical shape by burring method.

The protrusions 92 are engaged with the through holes 97*a*, 97*a* on the dimmer control terminal block attaching portion 97 of the terminal block support angle 96, to position the terminal block for dimmer control 9. Then, the screw 93 is inserted into the through hole 97*a* and screwed into the screw hole of the terminal block for dimmer control 9, to fix the terminal block for dimmer control 9 to the terminal block support angle 96. Similarly, the protrusion 84 is engaged with the through hole 98*b* on the power supply terminal block attaching portion 98 of the terminal block support angle 96, to position the terminal block for power supply 8. Then, the screw 85 is inserted into the through hole 83 of the terminal block for power supply 8 and screwed into the female screw portion 98*a* of the power supply terminal block attaching portion 98, to fix the terminal block for power supply 8 to the terminal block support angle 96. Alternatively, a tapping screw may be utilized for the screw hole of the terminal block for dimmer control 9, instead of the screw 93.

A terminal block cover 86 is attached to cover the terminal block for power supply 8 described above. The terminal block cover 86 is configured with an top plate portion 87 formed in a rectangular plate shape, a lateral plate portions 88, 88 extending from two parallel sides of the top plate portion 87 and formed in rectangular plate shapes, and bottom plate portions 89, 89 arranged in parallel to the top plate portion 87 and extending from sides of the lateral plate portions 88, 88 opposite to the sides connected to the top plate portion 87. A through hole 87*a* is provided to the top plate portion 87 of the terminal block cover 86. As described above, the terminal block cover 86 is put over the terminal block for power supply 8 fixed to the terminal block support angle 96 from the surface where the connection terminals 81, 81, . . . are arranged.

One end of the dimmer control terminal block attaching portion 97 is engaged with the protrusion 13*f* provided at said another surface 13*b* of the heat exchanger plate 13, the power supply terminal block attaching portion 98 is disposed on the angle support portions 15, 15, and the screw 94 is inserted into the through hole 97*c* of the dimmer control terminal block attaching portion 97 of the terminal block support angle 96 and then screwed into the screw hole 11*d* of the terminal block fixing unit 11*c* of the cylinder 11 of the heat sink 1, to attach the terminal block support angle 96, to which the terminal block for power supply 8 and the terminal block for dimmer control 9 are attached as described above, to the heat sink 1. The screw 69 is inserted into the through hole 87*a* of the top plate portion 87 of the terminal block cover 86 and the through hole of the cover 16, and screwed into the screw hole of the boss portion 14*b* standing on the heat exchanger plate 13 of the heat sink 1, to fix the terminal block cover 86 to the cover 16 and the heat sink 1. Alternatively, tapping screws may be utilized for the screw hole 11*d* and the screw hole of the boss portion 14*b*, instead of the screws 94, 69.

Figure 11:
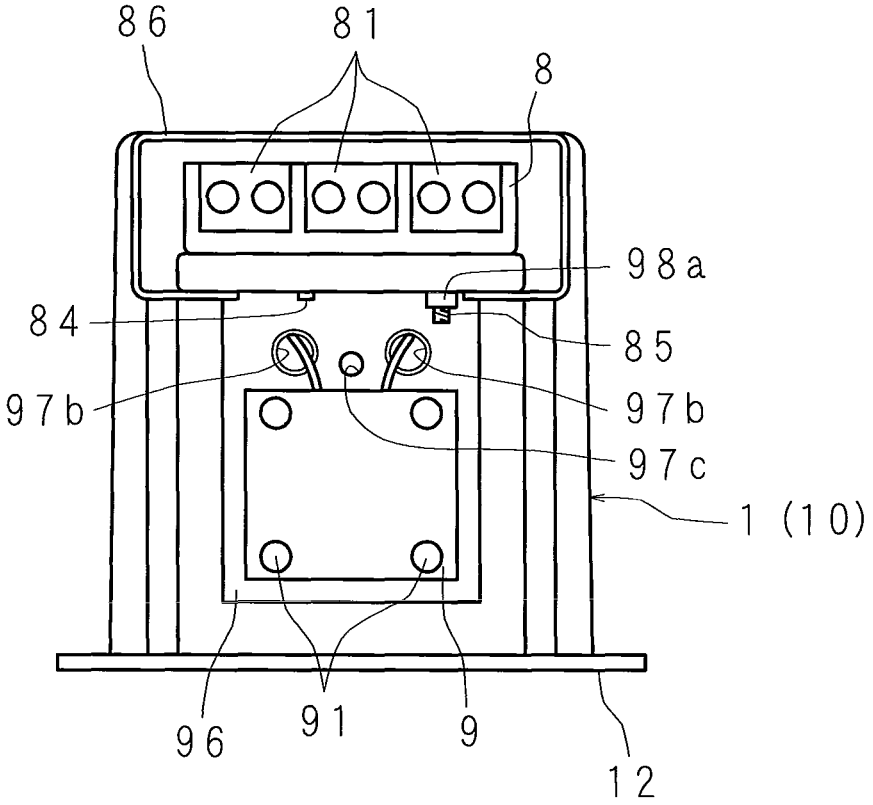
FIG. 11 is a schematic view showing attached terminal blocks.

FIG. 11 is a schematic view showing the attached terminal blocks. As shown in FIG. 11, the terminal block for power supply 8 and terminal block for dimmer control 9 attached as described above are attached to the main body 10 of the lighting apparatus in parallel with each other in the light emitting direction (vertical direction) of the lighting apparatus, and that the terminal block for dimmer control 9 is arranged at the side of flange 12 (the side of attaching hole when the lighting apparatus is installed in the attaching hole, i.e., the side of the mounted portion).

Figure 12:
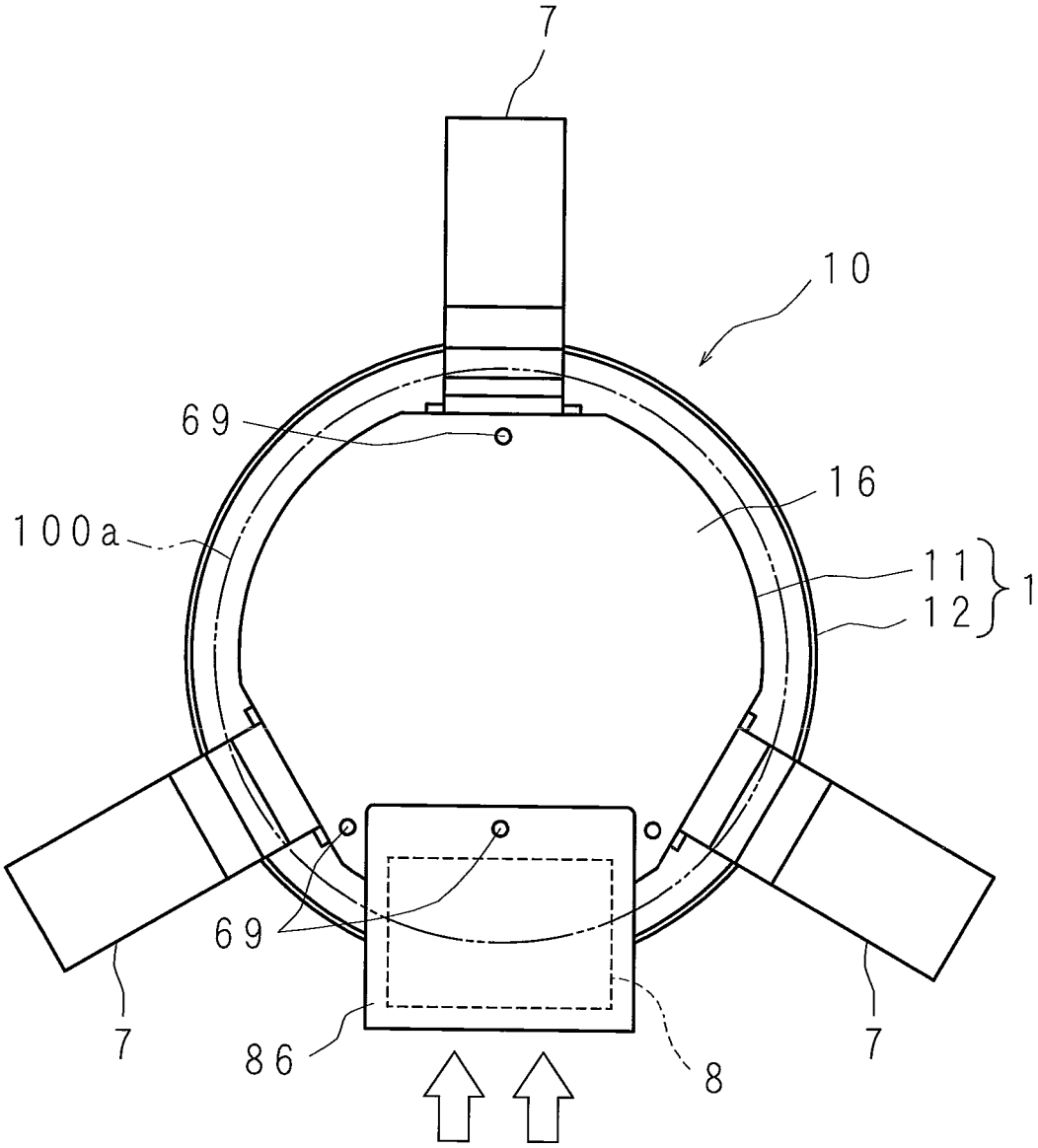
FIG. 12 is a schematic view showing the lighting apparatus, viewed from a side of a cover.
Figure 13:
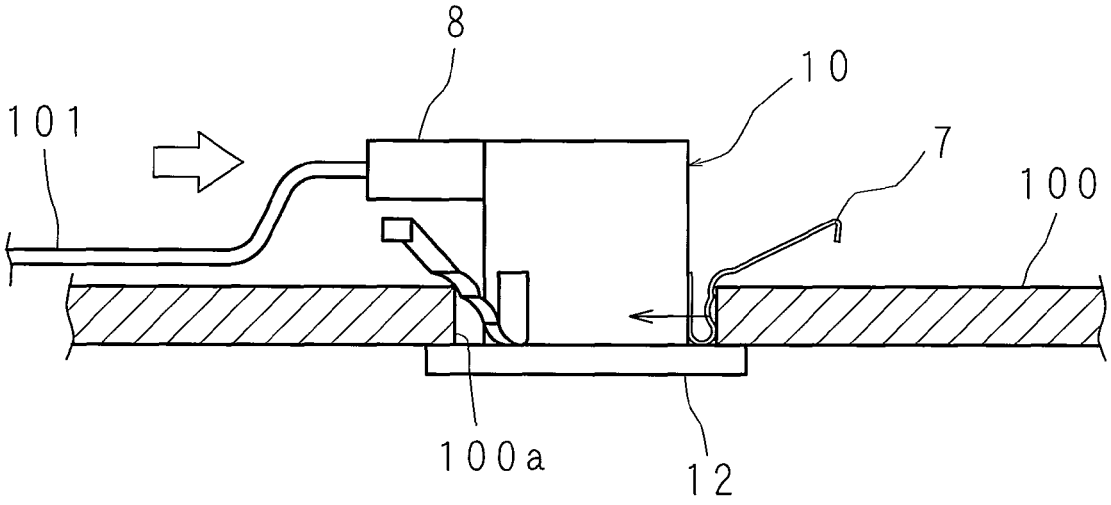
FIG. 13 is a view for explaining a posture of the installed lighting apparatus.

The lighting apparatus integrated as described above can be utilized as the so-called downlight in which the flange 12 side of the heat sink 1 is kept at the lower side and the leaf springs 7, 7 . . . work to fix the lighting apparatus to the mounted portion, i.e., the attaching hole of the ceiling. FIG. 12 is a schematic view showing the lighting apparatus, viewed from the side of the cover 16. The attaching hole 100*a* is indicated by two dot-chain line in FIG. 12. FIG. 13 is a view for explaining an posture of the installed lighting apparatus. For the explanation purpose, only the terminal block for power supply 8 is illustrated as the terminal block and the terminal block for dimmer control 9 is omitted in FIG. 12 and FIG. 13. Although this embodiment is illustrated to include two terminal blocks, i.e., terminal block for power supply 8 and terminal block for dimmer control 9, the present invention is not limited to that number of terminal blocks. Alternatively, one terminal block or more than two terminal blocks may be included.

In the lighting apparatus according to the present invention, the terminal block for power supply 8 is opposed through the attaching hole 100*a* to one of three leaf springs 7, 7 . . . , i.e., mounting members, as shown in FIG. 12. The terminal block for power supply 8 is connected to the power cable 101, i.e., electric power line for supplying power to the light source unit 2, as shown in FIG. 13. For example, the power cable 101 is connected to the terminal block for power supply 8 of the lighting apparatus and then the lighting apparatus is installed to the attaching hole 100*a*, to install the lighting apparatus to the ceiling. In that example case, the power cable 101 is pulled toward the room side and connected to the connection terminal 81 of the terminal block for power supply 8. While the leaf springs 7, 7 . . . are pushed to the side of lighting apparatus main body 10, the lighting apparatus is inserted from the side of terminal block for power supply 8 into the attaching hole 100*a* of the ceiling 100. Then, after the leaf springs 7, 7 . . . are released, the user further pushes the main body 10 of the lighting apparatus. As the result, the lighting apparatus is fixed to the attaching hole 100*a* as shown in FIG. 13, while the surface of flange 12 of the heat sink 1 at the cylinder 11 side is in tight contact with the installation surface of the ceiling 100 at the room side (the flange 12 that is a part of the heat sink 1 is positioned outside the attaching hole 100*a*).

When the lighting apparatus is installed to the attaching hole 100*a* of the ceiling 100 as described above, a bend not shown in figures may be caused on the power cable 101. As the direction of force pulling the power cable 101 is generally identical to the direction for connecting the power cable 101 to the terminal block for power supply 8 (indicated by white arrows in FIG. 12 and FIG. 13), the force in the connecting direction of the power cable 101 acts on the main body 10 of the lighting apparatus. At that time, the leaf spring 7 opposed to the terminal block for power supply 8 generates another force in a direction substantially opposite to the connecting direction (indicated by the arrow in FIG. 13) and said another force acts on the main body 10 of the lighting apparatus. Thus, against the force regarding the power cable 101, the leaf spring 7 can prevent the main body 10 of the lighting apparatus from leaning with respect to the ceiling 100. Therefore, it is possible to keep the posture of lighting apparatus and improve the stability.

Since the direction of the perpendicular line through the center of cylinder 11 to the terminal block fixing unit 11*c* is equal to the radial direction of the cylinder 11, as described above, the direction for connecting the electric wire to the terminal block for power supply 8 and the terminal block for dimmer control 9 is substantially equal to the radial direction of the main body 10 of the lighting apparatus. As described above, the direction for connecting the electric wire to the terminal block in the present invention is substantially equal to the direction from the terminal block to the center of lighting apparatus main body 10, in other words, from the terminal block to the center of attaching hole 100*a*. On the other hand, since the leaf springs 7, 7 . . . are attached to the cylinder 11 of the heat sink 1 spaced apart by similar distances in the circumferential direction of the lighting apparatus main body 10, the direction of force coming from the leaf springs 7, 7 . . . to the main body 10 of the lighting apparatus is substantially equal to the radial direction of the lighting apparatus main body 10. Thus, the direction for connecting the electric wire to the terminal block for power supply 8 and the terminal block for dimmer control 9 is substantially equal to the direction from the terminal block for power supply 8 and the terminal block for dimmer control 9 to the leaf spring 7 opposed to the terminal block for power supply 8 and the terminal block for dimmer control 9. Hence, the direction of the force regarding the power cable 101 becomes opposite to the direction of the force that acts on the main body 10 of the lighting apparatus and is generated by the opposite leaf spring 7. Therefore, it is possible to further facilitate keeping the posture of the lighting apparatus and to further improve the stability. Furthermore, it is possible to avoid the generation of gap between attaching hole 100*a* at the room side, opened on the ceiling, and the lighting apparatus, preventing the gap from causing reduction in the installation quality, degradation in the air tightness, reduction in installation strength to the ceiling and the like.

As described above, the terminal block for power supply 8 and the terminal block for dimmer control 9 are arranged in parallel with each other on the main body 10 of the lighting apparatus. Thus, similar advantage can be expected for the signal line connected to the terminal block for dimmer control 9. Therefore, it is possible to further improve the stability for the posture of the lighting apparatus.

In this embodiment, the terminal block for power supply 8 is arranged farther from the attaching hole 100*a* (flange 12 of the heat sink 1) than the terminal block for dimmer control 9. The reason is that the power cable, i.e., electric power line generally has a larger diameter and higher rigidity than the signal line and the terminal block connected to the electric wire having higher rigidity is arranged farther to the attaching hole than the other terminal block. If the signal line has higher rigidity, the positional relationship between the terminal block for power supply 8 and the terminal block for dimmer control 9 would be opposite to the case in the present embodiment. When the lighting apparatus is installed to the attaching hole 100*a* as described above, the electric wire closer to the attaching hole 100*a* is reflected by a larger degree. Thus, it is possible to reduce the positional interference due to the attaching hole, by arranging the electric wire having higher rigidity farther from the attaching hole 100*a*, in other words, the ceiling which is the mounted portion. Therefore, it is possible to facilitate installing the lighting apparatus to the attaching hole even while the electric wire is connected.

Three leaf springs 7, 7 . . . are utilized as the mounting members. Therefore, it is possible to minimize the number of mounting members for keeping the stability for the posture of the lighting apparatus.

Since the terminal block for power supply 8 and the terminal block for dimmer control 9 are arranged at positions in the same circumferential direction of the lighting apparatus as described above, it is not required to rotate the lighting apparatus and to shift it from one hand to the other hand. Therefore, it is possible to easily connect the electric wire. Furthermore, in the case that lighting apparatus is installed to the attaching hole 100*a* of the ceiling 100 after wired, the lighting apparatus will be inserted from the side of the terminal block for power supply 8 into the attaching hole 100*a* of the ceiling. Thus, the electric wire is inserted into the attaching hole 100*a*, firstly. Therefore, it is possible to facilitate installing the lighting apparatus, because the electric wire does not disturb the installation.

Since the terminal block for power supply 8 and the terminal block for dimmer control 9 are arranged between the leaf springs 7, 7 . . . while the direction for connecting the electric wire to the terminal block for power supply 8 and the terminal block for dimmer control 9 is configured to be equal to the radial direction of the attaching hole 100*a*, it is possible to prevent the leaf springs 7, 7 . . . from damaging the electric wire at the time of installing the lighting apparatus. In addition, since the terminal block for dimmer control 9 is arranged further inside than the maximum external diameter of the cylinder 11, i.e., further inside than the diameter of attaching hole 100*a*, it is possible not only to reduce the size of the lighting apparatus but also to facilitate installing the lighting apparatus.

Except for the leaf spring opposed to the terminal block for power supply 8, the leaf springs 7, 7 . . . are arranged symmetrically about the line extending from the center of attaching hole 100*a* to the leaf spring 7 opposed to the terminal block for power supply 8, i.e., about the line extending from the arranged center of the terminal block for power supply 8 to the arranged center of the leaf spring 7 opposed to the terminal block for power supply 8, as shown in FIG. 12. Thus, it is possible not only to balance the force of leaf springs 7, 7 . . . pressing the ceiling, i.e., mounted portion, but also to balance the weight of leaf springs 7, 7 . . . . Therefore, it is possible to keep the stable posture of the lighting apparatus installed to the ceiling.

Figure 14:
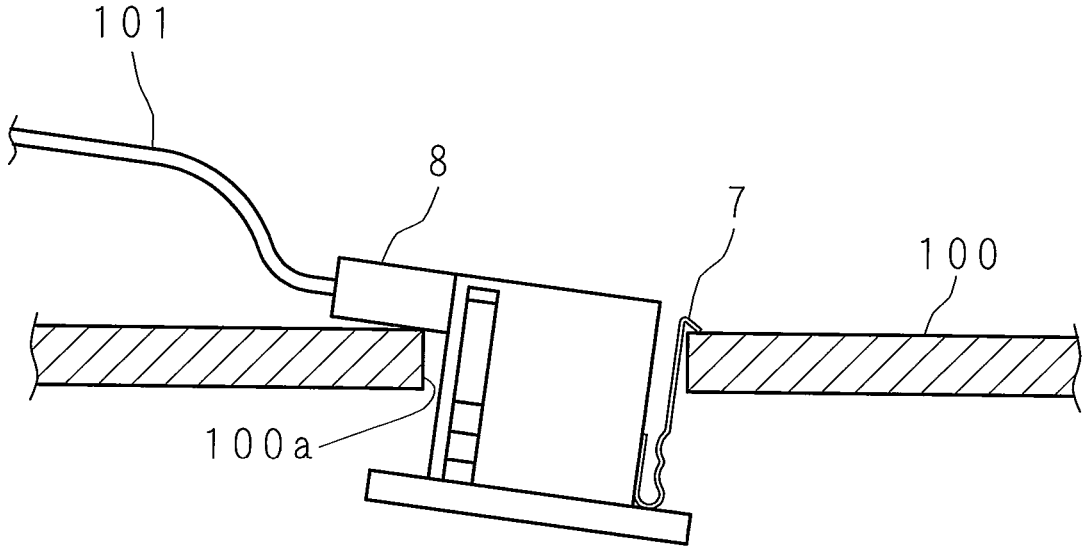
FIG. 14 is a view for explaining another posture of the lighting apparatus in which a first pressing portion and a second pressing portion of the leaf spring are not in contact with a ceiling.

As shown in FIG. 12, the terminal block for power supply 8 is arranged outside the diameter of the attaching hole 100*a*. FIG. 14 is a view for explaining the posture of the lighting apparatus in which the first pressing portion and the second pressing portion of the leaf spring are not in contact with the ceiling. In the case that the first pressing portion 73 and the second pressing portion 75 of the leaf spring 7 are not in contact with the ceiling, not only the dislocation preventing portion 77 of the leaf spring 7 but also the terminal block support angle 96 supporting the terminal block for power supply 8 is in contact with the ceiling 100, as shown in FIG. 14. Therefore, it is possible to improve the safety, because the main body 10 of the lighting apparatus becomes less likely to fall from the ceiling.

Figure 15:
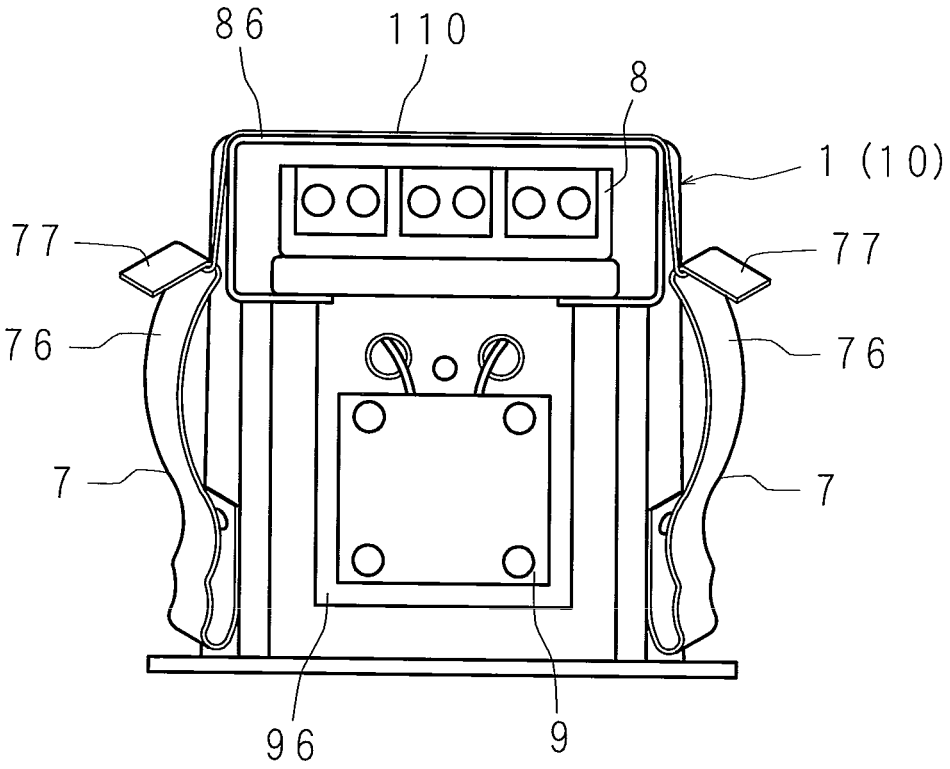
FIG. 15 is a view to explain packing the lighting apparatus.

It is considered to design the packing of the lighting apparatus in view of the terminal block for power supply 8 arranged outside the diameter of the attaching hole 100*a* (the external diameter of the cylinder 11 of the lighting apparatus main body 10). FIG. 15 is a view to explain packing of the lighting apparatus.

As shown in FIG. 15, the wire 110 is kept inside the "V" shape portion of the leaf spring 7 configured with the arm portion 76 and the dislocation preventing portion 77 and kept on the upper surface of the terminal block cover 86, and the leaf springs 7, 7 . . . pushed toward the main body 10 of the lighting apparatus, in order to pack the lighting apparatus. The wire 110 is a thin line whose cross section is formed in a circular shape, and is made of resin. Since kept on the upper surface of the terminal block cover 86 as described above, the wire 110 becomes less likely to fall and be disconnected from the lighting apparatus. In the case that the user puts the main body 10 of the lighting apparatus into the attaching hole 100*a* of the ceiling 100 and then cuts the wire 110, the user does not need to push the leaf springs 7, 7 . . . to the main body 10 of the lighting apparatus. Therefore, it is possible to facilitate installing the lighting apparatus.

Figure 16:
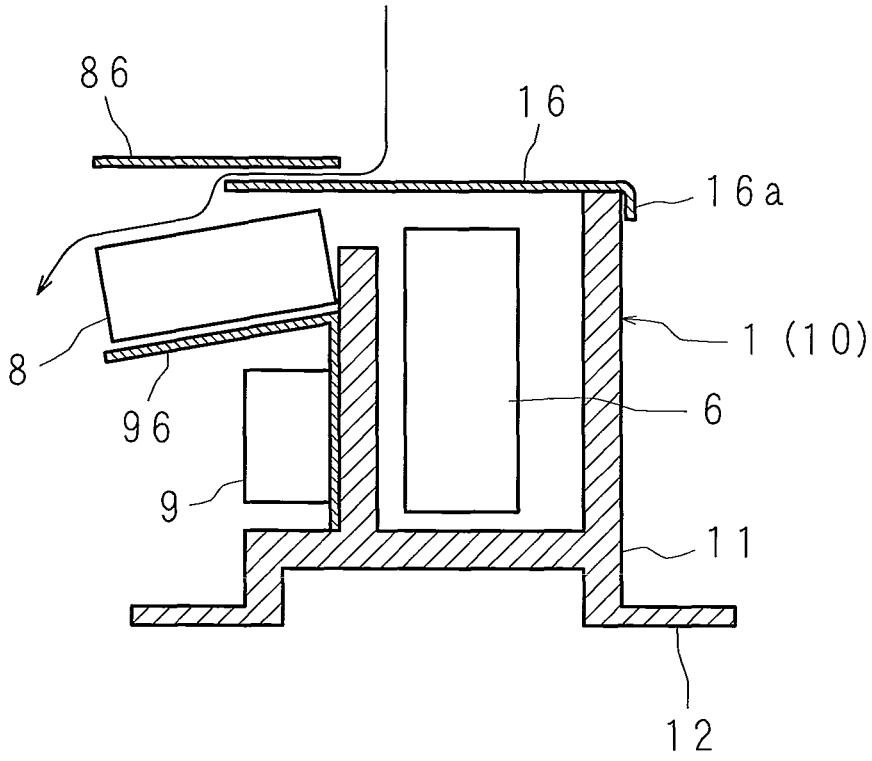
FIG. 16 is a view showing an example of the inclined terminal block for power supply.

It is preferable that the terminal block for power supply 8 is arranged to gently lean downward from the side of lighting apparatus main body 10 (inner side) to the opposite side (outer side), in other words, that the angle formed by the dimmer control terminal block attaching portion 97 and the power supply terminal block attaching portion 98 of the terminal block support angle 96 is less than 90 degrees. FIG. 16 is a view showing an example of the inclined terminal block for power supply 8. It should be noted that the inclined angle is exaggeratedly illustrated in FIG. 16 for the explanation purpose.

Since the terminal block for power supply 8 is arranged to lean downward as shown in FIG. 16, it is possible to prevent water from coming inside the power source accommodating portion configured by the heat sink 1 and the cover 16 even if the water comes into a gap between the cover 16 and the terminal block cover 86. Therefore, it is possible to protect the power supply unit 6. In addition, the peripheral wall 16*a* is arranged along the periphery of cover 16 covering the opening portion of the heat sink 1 except for the linear portion on which the terminal block is arranged, as described above, to surround the periphery of the cover 16. Therefore, it is possible to prevent the water from coming inside the power source accommodating portion and to protect the power supply unit 6.

Figure 17A:
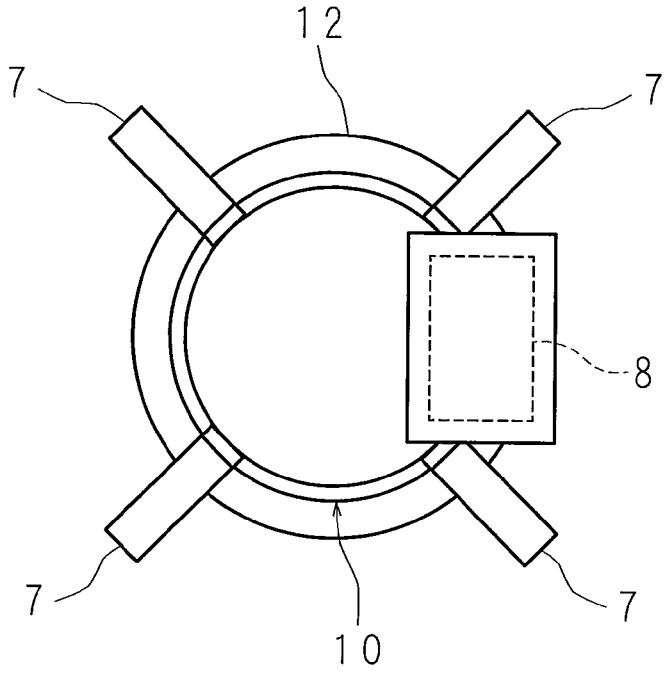
FIG. 17A is a schematic plain view showing the lighting apparatus including four leaf springs.
Figure 17B:
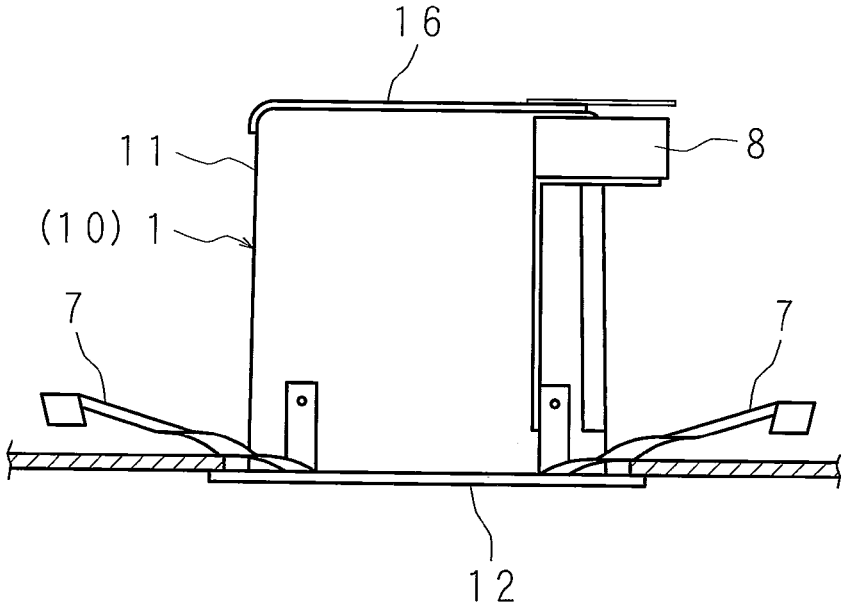
FIG. 17B is a schematic lateral view showing the lighting apparatus including four leaf springs.

Although this embodiment is illustrated about the lighting apparatus including three leaf springs 7, the present invention is not limited to this illustration. Alternatively, the number of leaf springs may be four or more. FIG. 17 shows an example of a lighting apparatus including four leaf springs. FIG. 17A is a schematic plain view showing the lighting apparatus, and FIG. 17B is a schematic lateral view showing the lighting apparatus.

In the lighting apparatus of FIG. 17, the terminal block for power supply 8 is arranged to oppose through the attaching hole 100*a* to two of four leaf springs 7, 7 . . . . When the force is generated in the connection direction by the power cable, i.e., electric power line connected to the terminal block for power supply 8, two leaf springs 7, 7 opposed to the terminal block for power supply 8 can prevent the main body 10 of the lighting apparatus from leaning with respect to the ceiling 100. Thus, it is possible to further keep the posture of the lighting apparatus and to further improve the stability. Therefore, it is possible not only to keep the stable installation but also to avoid reduction in the radiation performance.

The leaf springs opposed through the attaching hole to the terminal block should be arranged in the half area at the side farther from the terminal block with respect to the center line of the attaching hole that is perpendicular to the direction from the terminal block to the center of attaching hole, i.e., the area sandwiched by the opposed two leaf springs 7, 7 shown in FIG. 17. It is further preferable that the leaf springs are arranged on the line extending from the terminal block to the center of attaching hole. Although this embodiment is illustrated about the lighting apparatus including three or four leaf springs, similar configurations can be applied to the lighting apparatus including five or more leaf springs.

In the lighting apparatus described above, the heat generated in response to the light of the light source unit 2 on the heat exchanger plate 13 is transferred through the heat transferring sheet 20 to the heat exchanger plate 13, and then transferred from the heat exchanger plate 13 of the heat sink 1 to the cylinder 11.

When the lighting apparatus of the embodiment is installed to the ceiling having no heat insulated structure, the heat transferred to the cylinder 11 of the heat sink 1 is radiated by the natural convection and the like to the air around the lighting apparatus from the outer peripheral surface of the cylinder 11, the flange 12 integrated with the cylinder 11 and the cover 16 arranges at said another end lib of the cylinder 11. Therefore, it is possible to radiate the heat not only to the air in the ceiling from the cylinder 11 of the heat sink 1 and the cover 16, but also to the outside of the attaching hole from the flange 12, i.e., to the room air at the side where the light from the light source unit is emitted from the attaching hole.

When the lighting apparatus of the embodiment is installed to the ceiling having the heat insulated structure, the heat transferred to the cylinder 11 of the heat sink 1 is mainly transferred to the flange 12 and then radiated to the room air by the natural convection and the like.

Although having no structure of the radiator fin, the heat sink 1 according to the embodiment is integrated with the cylinder 11, flange 12 and the heat exchanger plate 13 as described above. Thus, it is possible to efficiently transfer the heat from the heat exchanger plate 13 to the flange 12 by the heat transfer inside the heat sink 1. When the lighting apparatus is installed to the attaching hole opened at the mounted portion, such as the ceiling, the flange 12 is positioned outside the attaching hole, for example, room inside or the like, i.e., exposed to the side where the light from the light source is emitted from the attaching hole. Thus, it is possible to efficiently radiate the heat generated from the light source unit 2 to the outside of the attaching hole, such as the room inside, i.e., to the air at the side where the light from the light source is emitted from the attaching hole. Although the heat sink 1 according to the embodiment is illustrated to include the cylinder 11 and the flange 12 arranged on the outer peripheral surface of the cylinder 11 at one side, the shape of it is not limited to the illustration. The heat sink 1 should include at least the port, such as the flange 12, exposed to the outside the attaching hole, such as room inside, i.e., exposed to the side where the light from the light source is emitted from the attaching hole.

The light source unit 2 in the heat sink 1 is positioned at the side of opening of the attaching hole. In the case of a recessed lighting apparatus partially or totally recessed into the attaching hole for the installation as in the present embodiment, the light source unit 2 is positioned at the side of opening but not at the back side, viewed from the center of lighting apparatus main body in the depth direction of the attaching hole. Thus, it is possible to shorten the heat transferring path from the position of the heat sink 1 where the light source unit 2 is arranged to the outside, i.e., to the flange 12 positioned at the side where the light from the light source unit is emitted from the attaching hole. Hence, the heat generated by the light source unit 2 can be efficiently transferred to the flange 12, and radiated from the flange 12 to the outside of the attaching hole, such as the room inside, i.e., the air at the side where the light from the light source unit is emitted from the attaching hole. Therefore, it is possible to further improve the radiation performance. For example, when the main body of the lighting apparatus is recessed for the installation into a through hole of a mounted portion, such as a thicker wall, said "side of opening" of the attaching hole means one opening side to which the flange 12 is attached, and the light source unit is positioned at said one opening side with respect to the intermediate point between said one opening of the through hole and the center of the through hole in the longitudinal direction.

The heat exchanger plate 13 that is the plate portion separating inside the cylinder 11 of the heat sink 1 is arranged at the side of one end 11*a* where the flange 12 is arranged. The light source unit 2 is arranged on the surface 13*a* at the side of said one end 11*a* of the heat exchanger plate 13. It is possible not only to shorten the heat transferring path from the heat exchanger plate 13 on which the light source unit 2 is arranged to the flange 12 positioned at the outside, but also to surely keep the sufficient cross-section area in which the heat is transferred between the heat exchanger plate 13 and the cylinder 11 and between the cylinder 11 and the flange 12. Hence, the heat generated by the light source is efficiently transferred to the flange 12 and radiated from the flange 12 to the outside of attaching hole, such as room inside, i.e., to the air at the side where the light from the light source unit is emitted from the attaching hole. Therefore, it is possible to improve the radiation performance.

Since the radiator fin structure is not required, it is possible to increase the size of the power source accommodating portion accommodating the power supply circuit. Furthermore, the configuration not requiring the radiator fin structure would lead the following advantages. It is possible to reduce the required amount of aluminum, and to reduce the weight. In the case of die casting method for the formation, it is possible to easily pull out the apparatus from the die and to integrate it with the flange 12. Therefore, it is possible not only to efficiently radiate the heat generated by the light source unit 2 as described above, but also to reduce the number of components. In addition, it is possible to facilitate the corrosion control, because the paint can be applied easily. Furthermore, it is possible to prevent degradation in radiation performance, because the outer surface is smooth and the dust is less likely accumulated.

Although the embodiment described above is illustrated to utilize LED modules 2, 2 . . . , as the light source, which include plural LED elements, the present invention is not limited to the illustration. It may utilize plural LED elements, another type of LED, an EL (electro luminescence) or the like.

Although the embodiment described above is illustrated to utilize the surface mounted LED as the light source, the present invention is not limited to the illustration. It may utilize another type of LED, the EL (electro luminescence) or the like.

Although the embodiment described above is illustrated about the recessed lighting apparatus, such as the downlight, installed to the attaching hole of the ceiling, the present invention is not limited to the illustrated lighting apparatus. The present invention can be applied to another type of lighting apparatus and another apparatus other than the lighting apparatus which includes a heat generating component. It should be understood that the embodiment described herein is only illustrative of the present invention and that various modifications may be made thereto without departing from the scope of the invention as defined in the appended claims.

EXPLANATION OF ITEM NUMBERS

1 heat sink (radiator)
11 cylinder
12 flange
13 heat exchanger plate (plate portion)
2 light source unit (light source)
6 power supply unit
64 support plate (support material)
7 leaf spring (mounting member)
8 terminal block for power supply
9 terminal block for dimmer control
100 ceiling (mounted portion)
100*a* attaching hole

The invention claimed is:

1. A recessed lighting apparatus that emits light in a predetermined direction, comprising:
a light source that generates the light;
a radiator that radiates heat generated by the light source;
a terminal block that is connected to plural electric wires for supplying power or signal; and
plural mounting members,
wherein
a part of the radiator is exposed in a direction opposite to the predetermined direction,
a direction for connecting the plural electric wires to the terminal block is substantially equal to a direction from the terminal block to at least one of the plural mounting members,
the terminal block is configured with a first terminal block portion and a second terminal block portion,
the first terminal portion is connected to an electric wire having a higher rigidity than an electric wire connected to the second terminal portion, and
a direction from the first terminal block portion to the second terminal block portion is substantially equal to the predetermined direction.

2. A recessed lighting apparatus according to claim 1, wherein
the recessed lighting apparatus is recessed to be utilized into an attaching hole.

3. A recessed lighting apparatus according to claim 2, wherein
the part of the radiator comprises a flange.

4. A recessed lighting apparatus according to claim 3, wherein
the radiator comprises a plate shaped portion, and
the light source is arranged on one surface of the plate shaped portion.

5. A recessed lighting apparatus according to claim 4, wherein
the radiator comprises a cylindrical shaped portion,
the flange is arranged at one end side of the cylindrical shaped portion.

6. A recessed lighting apparatus according to claim 5, further comprising:
a power supply unit that drives the light source, wherein
the plate shaped portion separates an internal space of the recessed lighting apparatus into a first space containing the one surface and a second space containing an opposite surface of the plate shaped portion opposite to the one surface, and
the power supply unit is arranged in the second space.

7. A recessed lighting apparatus according to claim 6, wherein
the power supply unit is thermally connected to the radiator.

8. A recessed lighting apparatus according to claim 5, wherein
each of the plural mounting members extends in a radial direction of the cylindrical shaped portion, and
the plural mounting members are spaced apart equally in a circumferential direction of the cylindrical shaped portion.

9. A recessed lighting apparatus according to claim 8, wherein
a direction for connecting the electric wire to the terminal block is substantially equal to a direction from the terminal block to a center in a radial direction of the recessed lighting apparatus.

10. A recessed lighting apparatus according to claim 9, wherein
the first terminal block portion is for supplying power to the light source, and
the second terminal block portion is for dimming the light generated by the light source.

11. A recessed lighting apparatus according to claim 8, wherein
the plural mounting members, except for a mounting member arranged opposite to the terminal block, are arranged symmetrically.

12. A recessed lighting apparatus according to claim 8, wherein
a number of the plural mounting members is three.

13. A recessed lighting apparatus according to claim 8, wherein
each of the plural mounting members is a leaf spring.

14. A recessed lighting apparatus according to claim 5, wherein
the flange and the cylindrical shaped portion are formed integrally.

15. A recessed lighting apparatus according to claim 2, wherein
the radiator comprises a cylindrical shaped portion, and
each of the plural mounting members extends in a radial direction of the cylindrical shaped portion, and
the plural mounting members are spaced apart equally in a circumferential direction of the cylindrical shaped portion.

* * * * *